US010875048B2

(12) United States Patent
Surma et al.

(10) Patent No.: US 10,875,048 B2
(45) Date of Patent: Dec. 29, 2020

(54) COATING APPARATUS WITH AN AUTOMATIC FLUID LEVEL SYSTEM, AND METHODS OF USING THE SAME

(71) Applicant: HARLAND MEDICAL SYSTEMS, INC., Eden Prairie, MN (US)

(72) Inventors: Michael Surma, Eagan, MN (US); Ryan Neumann, Burnsville, MN (US)

(73) Assignee: HARLAND MEDICAL SYSTEMS, INC, Eden Prairie, MN (US)

( * ) Notice: Subject to any disclaimer, the term of this patent is extended or adjusted under 35 U.S.C. 154(b) by 0 days.

(21) Appl. No.: 16/122,665

(22) Filed: Sep. 5, 2018

(65) Prior Publication Data

US 2019/0070630 A1 Mar. 7, 2019

Related U.S. Application Data

(60) Provisional application No. 62/554,497, filed on Sep. 5, 2017.

(51) Int. Cl.

| | |
|---|---|
| ***B05C 11/10*** | (2006.01) |
| ***B05C 3/10*** | (2006.01) |
| ***B05D 1/18*** | (2006.01) |

(52) U.S. Cl.

CPC ..... *B05C 11/101* (2013.01); *B05C 3/10* (2013.01); *B05D 1/18* (2013.01); *B05D 2256/00* (2013.01); *B05D 2258/02* (2013.01)

(58) Field of Classification Search

None

See application file for complete search history.

(56) References Cited

U.S. PATENT DOCUMENTS 4,338,879 A 7/1982 Makeev et al.
4,436,764 A * 3/1984 Nakazima ..... B05C 3/10 118/423

(Continued)

FOREIGN PATENT DOCUMENTS

| | | |
|---|---|---|
| WO | WO 2007/109332 | 9/2007 |
| WO | WO 2007/109333 | 9/2007 |
| WO | WO 2018/161079 | 9/2018 |

OTHER PUBLICATIONS

International Preliminary Report on Patentability for International (PCT) Patent Application No. PCT/US2018/049567, dated Mar. 19, 2020 8 pages.

(Continued)

*Primary Examiner* — Jethro M. Pence

(74) *Attorney, Agent, or Firm* — Sheridan Ross P.C.

(57) ABSTRACT

The present invention relates to a coating apparatus for an elongate workpiece and a method of operating the coating apparatus. The coating apparatus generally includes a first tray and a second tray with coating tubes interconnected to the trays. The coating apparatus is operable to automatically adjust the coating tubes to a predetermined volume of fluid. In one embodiment, the coating apparatus can fill a first coating tube interconnected to the first tray with a first fluid while the elongate workpiece is being dipped into a second fluid within a second coating tube interconnected to the second tray. Optionally, the coating apparatus includes a control system operable to activate a pump to fill the coating tubes with the predetermined volume of fluid. The control system can receive data from a sensor operable to determine a position of an upper surface of the fluid in a tray or a coating tube.

9 Claims, 9 Drawing Sheets

(56) References Cited

U.S. PATENT DOCUMENTS

| | | | | |
|---|---|---|---|---|
| 5,262,033 | A * | 11/1993 | Zega | C23C 2/02 118/419 |
| 5,429,618 | A | 7/1995 | Keogh | |
| 5,443,453 | A | 8/1995 | Walker et al. | |
| 5,454,650 | A | 10/1995 | Yamaguchi | |
| 5,531,715 | A | 7/1996 | Engelson et al. | |
| 5,538,512 | A | 7/1996 | Zenzon et al. | |
| 5,541,167 | A | 7/1996 | Hsu et al. | |
| 5,603,991 | A | 2/1997 | Kupiecki et al. | |
| 5,702,823 | A | 12/1997 | Forrestal et al. | |
| 6,254,921 | B1 | 7/2001 | Chappa et al. | |
| 7,381,273 | B2 | 6/2008 | Collins | |
| 7,597,937 | B2 | 10/2009 | Anderson et al. | |
| 8,133,545 | B2 | 3/2012 | Anderson et al. | |
| 8,245,660 | B2 | 8/2012 | Dillon et al. | |
| 8,247,019 | B2 | 8/2012 | Anderson et al. | |
| 2001/0040096 | A1* | 11/2001 | Yamamoto | G01N 27/44782 204/604 |
| 2006/0210699 | A1* | 9/2006 | Collins | B05C 13/02 427/2.1 |
| 2009/0223682 | A1* | 9/2009 | Ramos | A62C 3/0292 169/46 |
| 2010/0129545 | A1 | 5/2010 | Buck et al. | |
| 2011/0014386 | A1* | 1/2011 | Dillon | B05C 3/12 427/430.1 |
| 2015/0040825 | A1 | 2/2015 | Kulakovsky | |
| 2017/0058423 | A1* | 3/2017 | Mine | H01L 21/68785 |

OTHER PUBLICATIONS

"RDX-XL Series Coating Systems," Harland Medical Systems, Inc., 2009, 4 pages.

International Search Report and Written Opinion for International (PCT) Patent Application No. PCT/US18/49567, dated Nov. 30, 2018 9 pages.

* cited by examiner

COATING APPARATUS WITH AN AUTOMATIC FLUID LEVEL SYSTEM, AND METHODS OF USING THE SAME

CROSS REFERENCE TO RELATED APPLICATIONS

This application claims priority and benefits under 35 U.S.C. § 119(e) to U.S. Provisional Patent Application Ser. No. 62/554,497 filed on Sep. 5, 2017, which is incorporated herein in its entirety by reference.

FIELD OF THE INVENTION

The present invention relates to coating devices, a system and a method of filling a coating device with a coating, and a method of using a coating device to coat a workpiece. One aspect of the present invention is a method, such as dip coating, for coating the surfaces of workpieces. Another aspect is a system for coating the surfaces (internal, external or both) of workpieces. In one embodiment, the workpieces are long thin parts which may be cylindrical or tubular, such catheters, guidewires, introducers, and similar medical devices.

BACKGROUND

Many medical devices utilize elongate flimsy parts that are advantageously coated with various coatings including biological coatings. Examples of these parts could be either guide wires or catheters. These parts can often be up to 100 inches in length and may have a diameter of less than 0.030 inches.

One way to coat these flimsy elongate parts is to dip them into a solution and then draw them out at a controlled rate. Conventional applications of such dip coating techniques are described, for instance, in U.S. Pat. Nos. 5,429,618; 5,443,453; 5,464,650; 5,541,167; 5,531,715; 5,538,512; 5,603,991; 5,702,823; 6,254,921; 7,381,273; 7,597,937; 8,133,545; 8,245,660; 8,247,019; and PCT Publications WO 2007/109332; and WO 2007/109333, the disclosures of each are incorporated herein by reference in their entirety.

The standard industry practice is to fill a funnel tube that is not much larger in diameter than the part to be coated with the coating material to minimize the volume of fluid. As the part is dipped into the fluid in the funnel tube, some of the fluid is displaced by the volume of the part. The excess fluid typically flows over a top edge of the funnel tube. As the part is withdrawn from the funnel tube, more of the fluid intentionally adheres an exterior surface of the part. The loss of fluid from the funnel tube due to displacement of the part as well as fluid adhering to the part decreases the volume of the fluid in the funnel tube. The fluid in the funnel tube must frequently be replenished, typically each time a part is dipped into and extracted from the fluid. Maintaining the fluid in the funnel tube at a constant level is difficult, wastes fluid and time consuming.

Often, especially for biological coatings, the coating material is so expensive and has such a limited pot life that mixing a large tank of material to dip the device into is cost prohibitive. Examples of coating materials are described in PCT Application PCT/US18/20924, filed Mar. 5, 2018, which is incorporated herein by reference in its entirety. For these reasons, it is generally not feasible to provide a volume of fluid in the funnel tube sufficient to dip more than one part without refilling the tube. Accordingly, after a part is dipped and withdrawn from the fluid, the funnel tube must be refilled before another part may be dipped into the fluid.

Prior art dipping apparatus require an operator to refill the funnel tube after each dipping cycle. Unfortunately, this negatively impacts the efficiency of the dipping apparatus and increases operating expenses. For example, the dipping apparatus typically cannot be used to cure a coating or dip parts while the operator is refilling a funnel tube. Additionally, it is difficult to manually fill the funnel tube to a predetermined level. Moreover, the level of the coating determines the position of the coating on the part so that errors in the fill level cause errors in the length of the coating on the coated part. For example, if there is too little fluid in the funnel tube, a portion of the length of the part may not be coated to a desired level. If there is too much fluid in the funnel tube, the fluid may coat a portion of the part that does not require coating. Over filling the funnel tube may also result in spoilage or spillage. For example, fluid in the funnel tube may be spoiled by contamination from the part.

Because the fluids are often flammable and must be kept from possible ignition sources, if the fluid is spilled by the operator during the refilling process, the dipping apparatus may require cleaning before more parts can be dipped.

Accordingly, a need exists for systems and methods of consistently and efficiently filling a funnel tube of a coating apparatus with fluid to a predetermined level.

SUMMARY

An aspect of the present invention is directed to a coating apparatus that is operable to automatically adjust a level of fluid in a funnel tube. The coating apparatus may fill the funnel tube with a predetermined volume of the fluid. Optionally, the coating apparatus can adjust the level of the fluid by adding fluid or draining fluid from the funnel tube. In one embodiment, the apparatus can fill a first funnel tube with a first fluid while an elongate workpiece is being dipped into a second fluid within a second funnel tube. Additionally, or alternatively, in another embodiment the coating apparatus can automatically adjust a volume of fluid in the first funnel tube to be at and/or maintain a predetermined level.

Another aspect of the present invention is a method of coating an elongate workpiece with a fluid. The method includes filling a first coating tube with a first fluid while an elongate workpiece is aligned with a second coating tube. In one embodiment, the first coating tube is filled with the first fluid to a predetermined level. Additionally, or alternatively, the first coating tube may be filled with a predetermined volume of the first fluid. In one embodiment, the first coating tube is filled with the first fluid while the elongate workpiece is dipped in a second fluid within the second coating tube. In one embodiment, the first coating tube is associated with a first tray and the second coating tube is associated with a second tray.

Yet another aspect of the present invention is a non-transitory computer readable medium including instructions executable by a processor of a control system. The instructions cause the processor to operate a coating apparatus. The instructions include filling a first coating tube of the coating apparatus with a first fluid after an elongate workpiece is extracted from the first coating tube. In one embodiment, the first coating tube is filled with the first fluid to a predetermined level. Additionally, or alternatively, the first coating tube may be filled with a predetermined volume of the first fluid. In one embodiment, the first coating tube is filled with the first fluid while the elongate workpiece is aligned to be dipped into a second fluid within a second coating tube.

Optionally, the first coating tube may be filled with the first fluid when the elongate workpiece extends into the second fluid.

Another aspect is a coating apparatus operable to automatically fill a funnel tube with a predetermined volume of a first fluid. Additionally, or alternatively, in one embodiment the coating apparatus can automatically fill the funnel tube to a predetermined level. The coating apparatus may also automatically adjust the volume or level of fluid in the funnel tube. For example, the coating apparatus may add fluid, drain fluid, or maintain fluid in the funnel tube.

One aspect of the present invention is to provide an apparatus for coating an elongate workpiece with fluids. The apparatus generally includes, but is not limited to, one or more of: (1) a carriage with a securement device adapted to secure a first end of the elongate workpiece to the carriage; (2) a dip block spaced from the carriage, the dip block including a first tray for a first fluid and a second tray for a second fluid; (3) a vertical drive system operable to move the carriage relative to the dip block; (4) a first holder with a first coating tube extending downwardly from the first tray, the first holder configured to receive the first fluid; (5) a second holder with a second coating tube extending downwardly from the second tray, the second holder configured to receive the second fluid; (6) a horizontal drive element configured to move the dip block between a first position in which the first holder is aligned to receive a second end of the elongate workpiece and a second position in which the second holder is aligned to receive the second end of the elongate workpiece; (7) a first circulation system associated with the first tray, wherein the first circulation system is operable to automatically adjust the first fluid within the first tray; and (8) a second circulation system associated with the second tray, wherein the second circulation system is operable to automatically adjust the second coating tube with the second fluid.

In one embodiment, the first circulation system may adjust the first fluid within the first coating tube when the dip block is in the second position. Optionally, the second circulation system may adjust the second fluid within the second coating tube when the dip block is in the first position. Adjusting the first and second fluids may comprise increasing or decreasing a volume of the first and second fluids within the first and second coating tube. In one embodiment, the first circulation system is operable to automatically adjust a level of the first fluid in the first tray or within the first coating tube while the second end of the elongate workpiece is within the second coating tube.

In one embodiment, the apparatus includes a first sensor associated with the first tray. The first sensor is operable to determine a level of a surface of the first fluid in at least one of the first tray and the first coating tube. The first sensor may be a fiber optic fluid level sensor.

In another embodiment, the first circulation system can comprise a first pump operable to move the first fluid from a first fluid reservoir to the first tray. Optionally, the first pump may withdraw the first fluid from the first coating tube. The apparatus may also include a first weir in the first tray. The first weir can be interconnected to the first fluid reservoir. Accordingly, when the vertical drive system lowers the carriage and the second end of the elongate workpiece can move into the first coating tube, and some of the first fluid can be expelled from the first coating tube thereby flowing over the first weir and into the first fluid reservoir.

Optionally, the apparatus can further comprise a control system in communication with the apparatus. In one embodiment, the control system can operate to one or more of: (a) receive data from a sensor; (b) determine if the first fluid is not at a predetermined level in one or more of the first tray and the first coating tube; and (c) when the dip block is in the second position, activate a pump to move more of the first fluid into the first tray and the first coating tube. In another embodiment, the control system can further operable to: (a) generate a user interface; (b) display the user interface on an output device; and/or (c) receive an input from an operator to set the predetermined level.

In one embodiment, the first holder includes a body with an upper opening to receive the second end of the elongate workpiece. Optionally, the body further comprises an aperture through the body. The aperture is configured to facilitate a flow of the first fluid into the first coating tube. In one embodiment, the aperture extends generally transverse to a longitudinal axis of the body.

In another embodiment, the apparatus includes at least two trays. In some embodiments the apparatus includes from two to six trays. Each tray includes a holder with a coating tube. The trays are each configured to hold a fluid for coating the elongate workpiece. In one embodiment, the fluid of each one of the two to six trays is different.

It is another aspect of the present invention to provide a method of coating an elongate workpiece with a fluid. The method generally comprises: (1) aligning a first coating tube with a free end of the elongate workpiece, the first coating tube including a first fluid; (2) moving the elongate workpiece toward the first coating tube such that the free end extends into the first fluid within the first coating tube; (3) extracting the elongate workpiece from the first coating tube; (4) moving the first coating tube such that the free end of the elongate workpiece is not aligned with the first coating tube; and (5) adjusting (e.g. by filling, draining or monitoring) the first fluid within the first coating tube.

In one embodiment, moving the first coating tube comprises aligning a second coating tube with the free end of the elongate workpiece. Optionally, the adjustment of the first fluid in the first coating tube occurs while the free end of the elongate workpiece extends into the second coating tube. Additionally, or alternatively, the method may further include adjusting the second coating tube with a second fluid while the free end of the elongate workpiece extends into the first coating tube.

In one embodiment, the method includes activating a pump to add the first fluid to the first coating tube. Additionally, or alternatively, the method can also include activating the pump or opening a drain valve to remove the first fluid from the first coating tube.

The method may optionally include aligning the elongate workpiece with one or more of a third coating tube and a fourth coating tube. The elongate workpiece may then be moved into a third fluid and a fourth fluid within the respective third and fourth coating tubes.

Another aspect of the present invention is a non-transitory computer readable medium comprising a set of instructions stored thereon which, when executed by a processor of a control system, cause the processor to operate a coating apparatus that coats an elongate workpiece with a fluid by, but not limited to, one or more of: (1) aligning a first coating tube of the coating apparatus with a free end of the elongate workpiece; (2) moving the elongate workpiece toward the first coating tube such that the free end extends into a first fluid within the first coating tube; (3) extracting the elongate workpiece from the first coating tube; (4) moving the first coating tube such that the free end of the elongate workpiece is not aligned with the first coating tube; and (5) adjusting the first fluid within the first coating tube. Optionally, adjusting the first fluid within the first coating tube may include at least one of adding the first fluid, removing or draining the first fluid, or monitoring an amount of the first fluid.

In one embodiment, moving the first coating tube comprises aligning a second coating tube with the free end of the elongate workpiece. Optionally, the adjusting of the first fluid within the first coating tube occurs while the free end of the elongate workpiece extends into the second coating tube. In another embodiment, the computer readable medium further comprises instructions to adjust a level of a second fluid within the second coating tube. In one embodiment, adjusting the level of the second fluid occurs while the free end of the elongate workpiece extends into the first coating tube.

Adjusting the first fluid within the first coating tube may comprise activating a pump to add the first fluid to the first coating tube. Optionally, the instructions cause the processor to activate the pump or open a drain valve to remove the first fluid from the first coating tube.

In one embodiment, the instructions further cause the processor to operate the coating apparatus by: (1) receiving data from a sensor; (2) determining if the first fluid in the first coating tube or in a first tray associated with the first coating tube is above or below a predetermined level; and (3) activating a pump until the first fluid is at the predetermined level in the first tray. In one embodiment, the pump may be activated when the free end of the elongate workpiece is not aligned with the first coating tube. Optionally, activating the pump comprises at least one of adding and removing at least some of the first fluid to or from the first coating tube and/or the first tray.

Additionally, or alternatively, the instruction may also cause the processor to operate the coating apparatus by: (1) generating a user interface; (2) displaying the user interface on an output device; and (3) receiving an input from an operator to set a predetermined level for the first fluid the first coating tube or in a first tray associated with the first coating tube. After the predetermined level is set, the processor may automatically maintain or adjust the volume of the first fluid in the first coating tube or in the first tray.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about." Accordingly, unless otherwise indicated, all numbers expressing quantities, dimensions, conditions, ratios, ranges, and so forth used in the specification and claims may be increased or decreased by approximately 5% to achieve satisfactory results. In addition, all ranges described herein may be reduced to any sub-range or portion of the range, or to any value within the range without deviating from the invention.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The term "automatic" and variations thereof, as used herein, refer to any process or operation done without material human input when the process or operation is performed. However, a process or operation can be automatic, even though performance of the process or operation uses material or immaterial human input, if the input is received before the performance of the process or operation. Human input is deemed to be material if such input influences how the process or operation will be performed. Human input that consents to the performance of the process or operation is not deemed to be "material."

The term "bus" and variations thereof, as used herein, can refer to a subsystem that transfers information and/or data between various components. A bus generally refers to the collection communication hardware interface, interconnects, bus architecture, standard, and/or protocol defining the communication scheme for a communication system and/or communication network. A bus may also refer to a part of a communication hardware that interfaces the communication hardware with other components of the corresponding communication network. The bus may be for a wired network, such as a physical bus, or wireless network, such as part of an antenna or hardware that couples the communication hardware with the antenna. A bus architecture supports a defined format in which information and/or data is arranged when sent and received through a communication network. A protocol may define the format and rules of communication of a bus architecture.

A "communication modality" can refer to any protocol or standard defined or specific communication session or interaction, such as Voice-Over-Internet-Protocol ("VoIP), cellular communications (e.g., IS-95, 1G, 2G, 3G, 3.5G, 4G, 4G/IMT-Advanced standards, 3GPP, WIMAX™, GSM, CDMA, CDMA2000, EDGE, 1×EVDO, iDEN, GPRS, HSPDA, TDMA, UMA, UMTS, ITU-R, and 5G), Bluetooth™, text or instant messaging (e.g., AIM, Blauk, eBuddy, Gadu-Gadu, IBM Lotus Sametime, ICQ, iMessage, IMVU, Lync, MXit, Paltalk, Skype, Tencent QQ, Windows Live Messenger™ or Microsoft Network (MSN) Messenger™, Wireclub, Xfire, and Yahoo! Messenger™), email, Twitter (e.g., tweeting), Digital Service Protocol (DSP), and the like.

The term "communication system" or "communication network" and variations thereof, as used herein, can refer to a collection of communication components capable of one or more of transmission, relay, interconnect, control, or otherwise manipulate information or data from at least one transmitter to at least one receiver. As such, the communication may include a range of systems supporting point-to-point or broadcasting of the information or data. A communication system may refer to the collection individual communication hardware as well as the interconnects associated with and connecting the individual communication hardware. Communication hardware may refer to dedicated communication hardware or may refer a processor coupled with a communication means (i.e., an antenna) and running software capable of using the communication means to send and/or receive a signal within the communication system. Interconnect refers to some type of wired or wireless communication link that connects various components, such as communication hardware, within a communication system. A communication network may refer to a specific setup of a communication system with the collection of individual communication hardware and interconnects having some definable network topography. A communication network may include wired and/or wireless network having a pre-set to an ad hoc network structure.

The term "computer-readable medium," as used herein refers to any tangible storage and/or transmission medium that participates in providing instructions to a processor for execution. Such a medium may take many forms, including but not limited to, non-volatile media, volatile media, and transmission media. Non-volatile media includes, for example, non-volatile random access memory (NVRAM), or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, read only memory (ROM), a compact disc read only memory (CD-ROM), any other optical medium, punch cards, paper tape, any other physical medium with patterns of holes, a random access memory (RAM), a programmable read only memory (PROM), and erasable programmable read only memory EPROM, a FLASH-EPROM, a solid state medium like a memory card, any other memory chip or cartridge, a carrier wave as described hereinafter, or any other medium from which a computer can read. A digital file attachment to an e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored. It should be noted that any computer readable medium that is not a signal transmission may be considered non-transitory.

The terms display and variations thereof, as used herein, may be used interchangeably and can be any panel and/or area of an output device that can display information to an operator or use. Displays may include, but are not limited to, one or more control panel(s), instrument housing(s), indicator(s), gauge(s), meter(s), light(s), computer(s), screen(s), display(s), heads-up display HUD unit(s), and graphical user interface(s).

The term "screen," "touch screen," "touchscreen," or "touch-sensitive display" refers to a physical structure that enables the user to interact with the computer by touching areas on the screen and provides information to a user through a display. The touch screen may sense user contact in a number of different ways, such as by a change in an electrical parameter (e.g., resistance or capacitance), acoustic wave variations, infrared radiation proximity detection, light variation detection, and the like. In a resistive touch screen, for example, normally separated conductive and resistive metallic layers in the screen pass an electrical current. When a user touches the screen, the two layers make contact in the contacted location, whereby a change in electrical field is noted and the coordinates of the contacted location calculated. In a capacitive touch screen, a capacitive layer stores electrical charge, which is discharged to the user upon contact with the touch screen, causing a decrease in the charge of the capacitive layer. The decrease is measured, and the contacted location coordinates determined. In a surface acoustic wave touch screen, an acoustic wave is transmitted through the screen, and the acoustic wave is disturbed by user contact. A receiving transducer detects the user contact instance and determines the contacted location coordinates.

The terms "determine," "calculate," and "compute," and variations thereof, as used herein, are used interchangeably and include any type of methodology, process, mathematical operation, or technique.

The Summary of the Invention is neither intended, nor should it be construed, as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE FIGURES

The accompanying drawings, which are incorporated herein and constitute a part of the specification, illustrate embodiments of the invention and together with the Summary of the Invention given above and the Detailed Description of the drawings given below serve to explain the principles of these embodiments. In certain instances, details that are not necessary for an understanding of the disclosure or that render other details difficult to perceive may have been omitted. It should be understood, of course, that the present invention is not necessarily limited to the particular embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein. Additionally, it should be understood that the drawings are not necessarily to scale.

Figure 1:
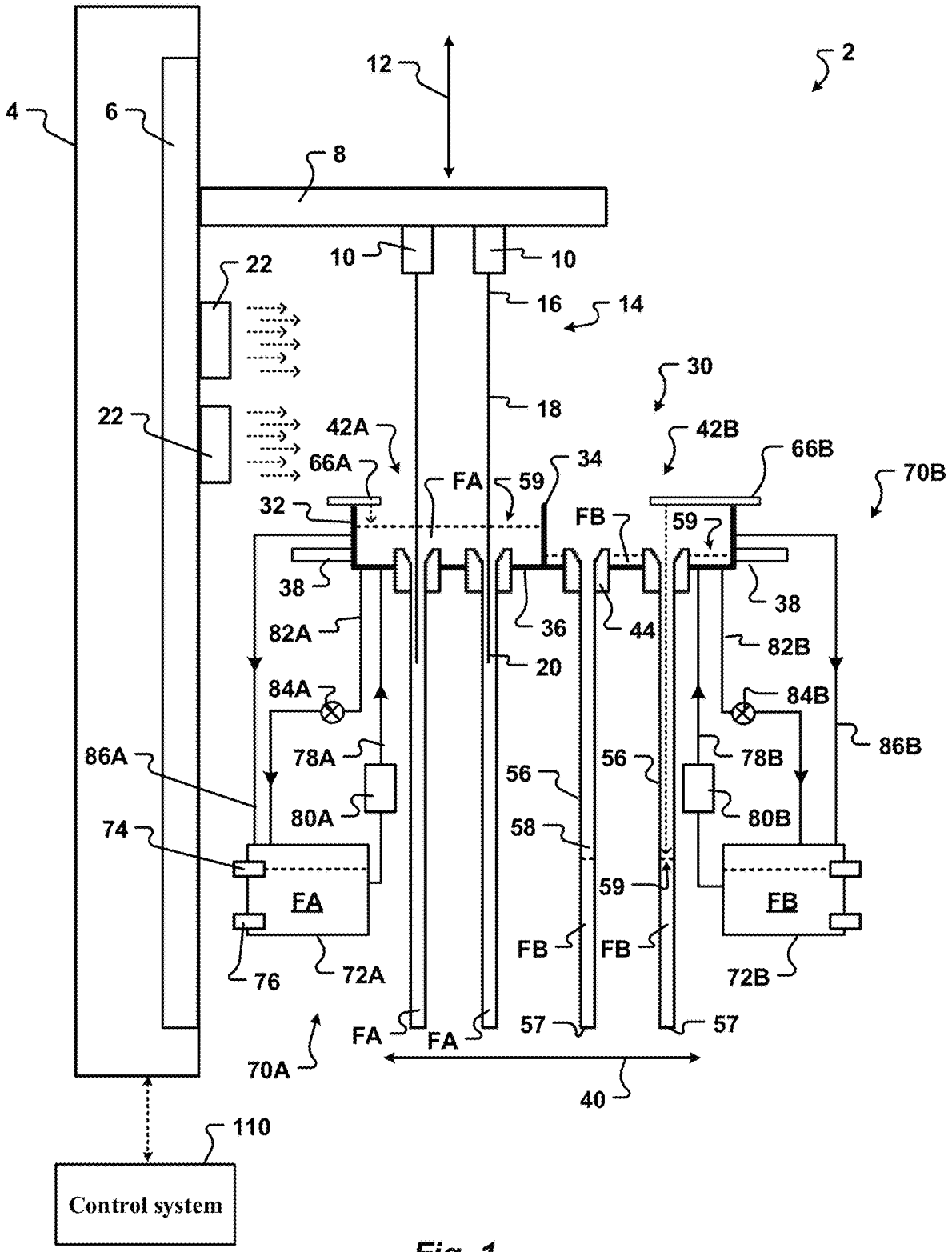
FIG. 1 is a schematic illustration of a coating apparatus of one embodiment of the present invention which includes two trays and illustrating a workpiece being dipped into a fluid of one of the trays.

Similar components and/or features may have the same reference number. Components of the same type may be distinguished by a letter following the reference number. If only the reference number is used, the description is applicable to any one of the similar components having the same reference number. To assist in the understanding of one embodiment of the present invention the following list of components and associated numbering found in the drawings is provided herein:

| Number | Component |
|---|---|
| 2 | Coating Apparatus |
| 4 | Support structure |
| 6 | Drive system |
| 8 | Carriage |
| 10 | Securement device |
| 12 | Arrow indicating vertical movement of carriage |
| 14 | Workpiece |
| 16 | First end |
| 18 | Intermediate portion |
| 20 | Second end |
| 22 | Curing element |
| 30 | Dip block |
| 32 | Sidewalls |
| 34 | Dividing wall |
| 36 | Base |
| 38 | Drive element |
| 40 | Arrow indicating movement of dip block |
| 42 | Trays |
| 44 | Holder |
| 46 | Body |
| 48 | Opening |
| 50 | Upper lip |
| 52 | Aperture |
| 54 | Seal element |
| 56 | Coating tube |
| 57 | Distal end of a coating tube |
| 58 | Lumen |
| 59 | Upper surface of fluid |
| 60 | Weir |
| 62 | Drain |
| 64 | Inlet |
| 66 | Sensor |
| 70 | Fluid circulating system |
| 72 | Reservoir |
| 74 | Full level sensor |
| 76 | Low level sensor |
| 78 | First conduit |
| 79 | Adjustment conduit |
| 80 | Pump |
| 82 | Second conduit |
| 84 | Valve |

-continued

| Number | Component |
|---|---|
| 86 | Third conduit |
| 88 | Adjustment element |
| 90 | Actuator for adjustment element |
| 92 | Arrow indicating vertical movement |
| 94 | Take-up spool |
| 96 | Spool exterior surface |
| 97 | Axis of take-up spool |
| 98 | Shaft |
| 100 | Head |
| 110 | Control system |
| 112 | Bus |
| 114 | Processing units or CPUs |
| 116 | Input device |
| 118 | Output device |
| 120 | Storage device |
| 122 | Computer-readable storage media reader |
| 124 | Communications system |
| 126 | Working memory |
| 128 | Processing acceleration unit |
| 130 | Database |
| 132 | Network |
| 134 | Remote database |
| 136 | Operating system |
| 138 | Other code or programs |
| 204 | User interface |
| 206A | Icon selected |
| 206B | Icon not-selected |
| 208 | Manual mode button |
| 210 | Button, fluid pump on |
| 212 | Button, deactivate fluid pump |
| 214 | Button, close drain valve |
| 216 | Button, open drain valve |
| 218 | Button, Tray auto fill on |
| 220 | Button, fluid A select |
| 222 | Button, fluid B select |
| 224 | Button, set tray A full level |
| 226 | Button, set tray B full level |
| 300 | Method of setting auto fill level for a fluid tray and/or a coating tube |
| 304 | Start operation |
| 308 | Move a tray out of a dipping position |
| 312 | Close a drain valve associated with the tray |
| 316 | Activate a pump associated with the tray |
| 320 | Deactivate the pump associated with the tray |
| 324 | Determine if correct volume of fluid is in the tray and/or the coating tube |
| 328 | Open the drain valve |
| 332 | Set automatic fill level for the tray and/or the coating tube |
| 336 | End operation |
| 400 | Method of operating a coating apparatus |
| 404 | Start operation |
| 408 | Set an automatic fill level |
| 412 | Move the first tray into a dipping position |
| 416 | Dip a workpiece into a first fluid of the first tray |
| 420 | Lift the workpiece out of the first fluid |
| 424 | Cure the workpiece |
| 428 | Move a second tray into the dipping position |
| 432 | Fill the first tray with the first fluid |
| 436 | Dip the workpiece in the second fluid |
| 440 | End operation |
| F | Fluid |
| FA | First fluid |
| FB | Second fluid |

DETAILED DESCRIPTION

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 2:
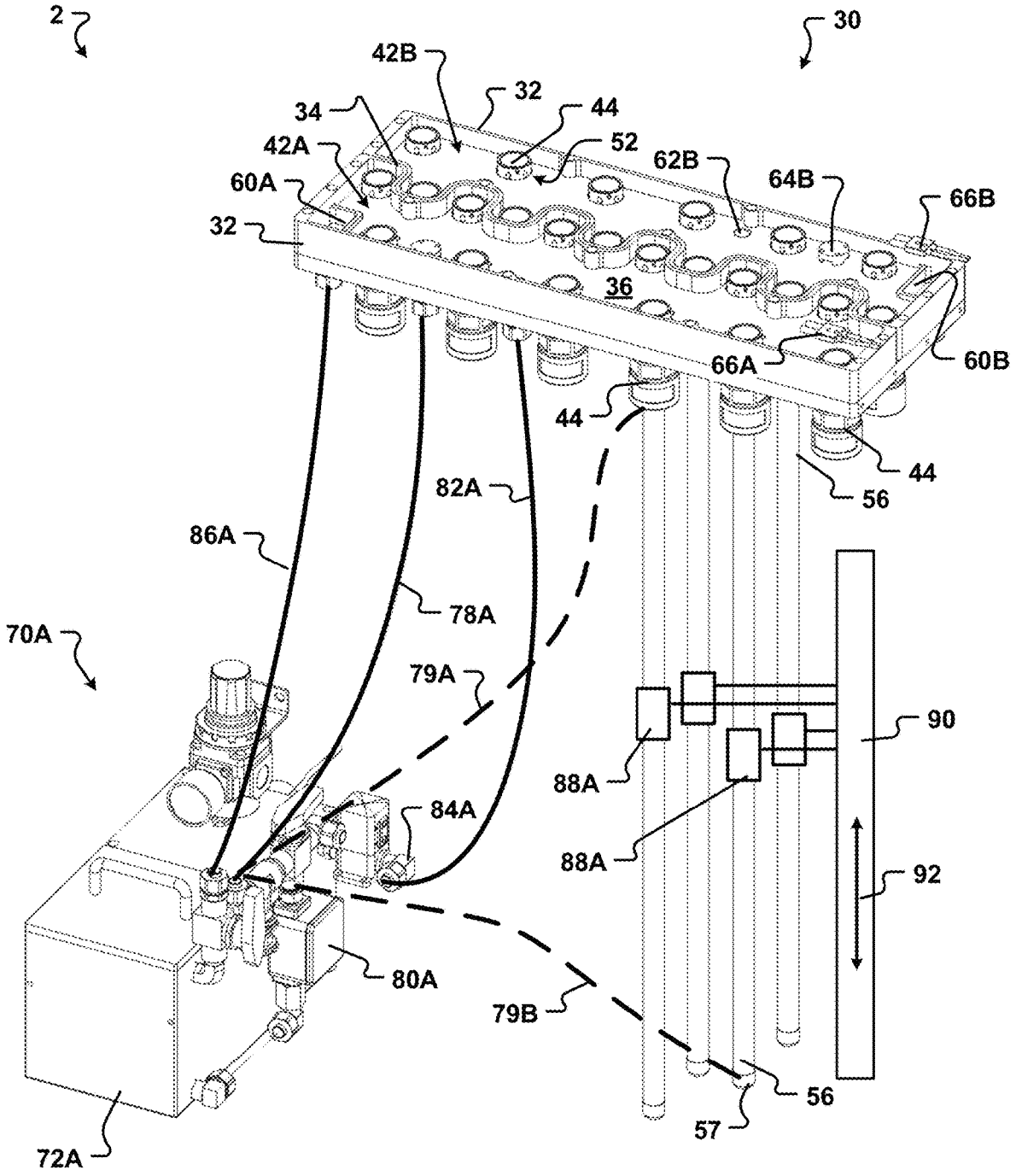
FIG. 2 is a perspective view of a dip block and a first fluid circulating system of the coating apparatus.

Referring now to FIGS. 1-3, a coating apparatus 2 of one embodiment of the present invention is generally illustrated. The coating apparatus 2 generally includes a support structure 4 with a drive system 6 operable to move a cassette or carriage 8 vertically with respect to the support structure. The drive system 6 can move the carriage 8 vertically, as indicated by the arrow 12, for lowering and withdrawing workpieces 14 affixed to the carriage 8 with respect to a dip block 30. In one embodiment, the drive system 6 comprises a servo or stepper motor associated with a belt or screw drive. Additionally, or alternatively, the drive system 6 may include a piston to move the carriage 8. In one embodiment, the drive system is a pneumatic actuator operable to move the carriage linearly.

In one embodiment, the carriage 8 is removably interconnectable to the support structure 4. The carriage 8 has a securement device 10 operable to secure a first end 16 of a workpiece 14 to the carriage. A second end 20 and an intermediate portion 18 of the secured workpiece 14 dangle downwardly from the securement device 10.

In one embodiment, the securement device 10 is configured as a clamping device, for example a collet. The securement device 10 may optionally be configured to rotate around a longitudinal axis that is approximately coaxial with the workpiece 14. In this manner, when the workpiece 14 is dipped in a fluid the workpiece can be rotated axially. Additionally, or alternatively, the securement device 10 can rotate the workpiece axially to evenly expose fluid on the workpiece to energy from a curing element 22.

The carriage 8 may have any number of securement devices 10. In one embodiment, the carriage 8 includes twelve securement devices 10. In another embodiment, the carriage 8 includes at least two securement devices 10, in some embodiments from two to forty securement devices 10. Optionally, the securement devices 10 are arranged in at least one row, in some embodiments two rows or more rows. Additionally, the securement devices 10 in a first row may be offset from the securement devices 10 in a second row.

In one embodiment, the workpiece 14 is elongate and generally cylindrical. The coating apparatus 2 may be configured to coat workpieces 14 of any length. In one embodiment, the coating apparatus 2 is configured to receive workpieces 14 with a length of up to approximately 300 cm. In another embodiment, the length of the workpieces is up to approximately 200 cm. Additionally, or alternatively, in another embodiment the coating apparatus 2 is configured to coat up to approximately 175 cm of the length of a workpiece. In one embodiment, the workpiece has a diameter of less than approximately 0.2 inches, or, in another embodiment, approximately 0.030 inches.

The workpiece 14 may be a medical device, such as a catheter (including a cardiovascular catheter or a urological catheter), a wire (including a guidewire), a spring, a lead (for example, a pacemaker lead) a stent, an implant, an antenna, a sensor, a needle (such as an intravenous ("iv") bag needle), a component of a ventricular assist device, an introducer, and a similar medical device. The material of the workpiece 14 can be a polymer, a metal, a glass, polyester block amides (for example Pebax™), a silicone rubber, nylons, polyvinylchlorides, styrene ethylene butadienes (SEBs), and combinations thereof.

The dip block 30 generally includes sidewalls 32, a dividing wall 34 and a base 36 that define a first tray 42A and a second tray 42B. As generally illustrated in FIG. 2, the dividing wall 34 may have a non-linear length. More specifically, in one embodiment of the present invention, the dividing wall 34 has a curvilinear shape to define a staggered boundary between the first tray 42A and the second tray 42B. In this manner, the shape of the dividing wall 34 decreases the width of the dip block 30, beneficially reducing the size of the coating apparatus 2. The small width of the dip block 30 also reduces the amount of linear movement required by the drive element 38 to move the trays into and out of a dipping position. The non-linear dividing wall 34 also decreases the volume required by the first and second trays 42A, 42B correspondingly decreasing the volume of the fluids F required to fill the trays.

A drive element 38 associated with the dip block 30 is operable to move the dip block laterally with respect to the support structure 4 as indicated by arrow 40. As generally illustrated in FIG. 1, the drive element 38 has moved the dip block 30 into a position in which the first tray 42A is aligned with workpieces 14 suspended from the carriage 8. Accordingly, the first tray 42A is in a dipping position. The second tray 42B is in a filling position. In one embodiment, the amount of movement required by the drive element 38 to move a tray 42 into and out of the dipping position is reduced due to the shape of the dividing wall 34.

Any suitable drive element 38 may be used with the coating apparatus 2 of the present invention. In one embodiment, the drive element 38 comprises a belt or screw drive driven by a servo or stepper motor. Additionally, or alternatively, the drive element 38 may include a piston operable to move the dip block 30. In one embodiment, the drive element 38 is a pneumatic actuator operable to move the dip block 30 substantially horizontally.

Each tray 42A, 42B is configured to hold a predetermined volume of a first fluid FA or a second fluid FB to coat the workpieces 14. The coating fluid F can be tailored for particular applications. For example, if an application requires that the bond between the workpiece 14 and the coating fluid is strong, then the coating fluid can be tailored so that it bonds with the workpiece. For example, if the workpiece is a polymer and an exterior surface of the polymer workpiece is hydrophobic, then the coating fluid can be formed such that the coating fluid exhibits a gradient where the hydrophobic crosslinker is close to the substrate and more hydrophilic crosslinkers are located at the surface.

In some embodiments of the invention, additives can be incorporated into the fluid F. Suitable additives include antimicrobial (including antibacterial) agents, binders, rheology modifiers, or colorants, and combinations of two or more additives. Suitable antimicrobial agents can include a silver compound, chlorhexidine, ciprofloxacin, and combinations thereof. Suitable rheology modifiers can include pluronics, alginates, carboxymethyl cellulose and combinations thereof. Suitable colorants can include dyes or oxide pigments, and combinations thereof. In one embodiment, the fluids F may be formulated to be cured by ultraviolet light generated by at least one curing element 22.

The trays 42 are configured to receive holders 44 with coating tubes 56. The coating tubes include a lumen 58. As will be appreciated by one of skill in the art, each tray 42 can be configured to hold any number of holders 44. The trays 42 typically include a number of holders 44 equal to the number of securement devices 10 of the carriage 8. In one embodiment, the trays 42 are configured to receive twelve holders 44. In another embodiment, the trays 42 may include from two to forty holders 44. Optionally, the holders 44 are arranged in two rows or more rows in each of the trays.

Figure 3A:
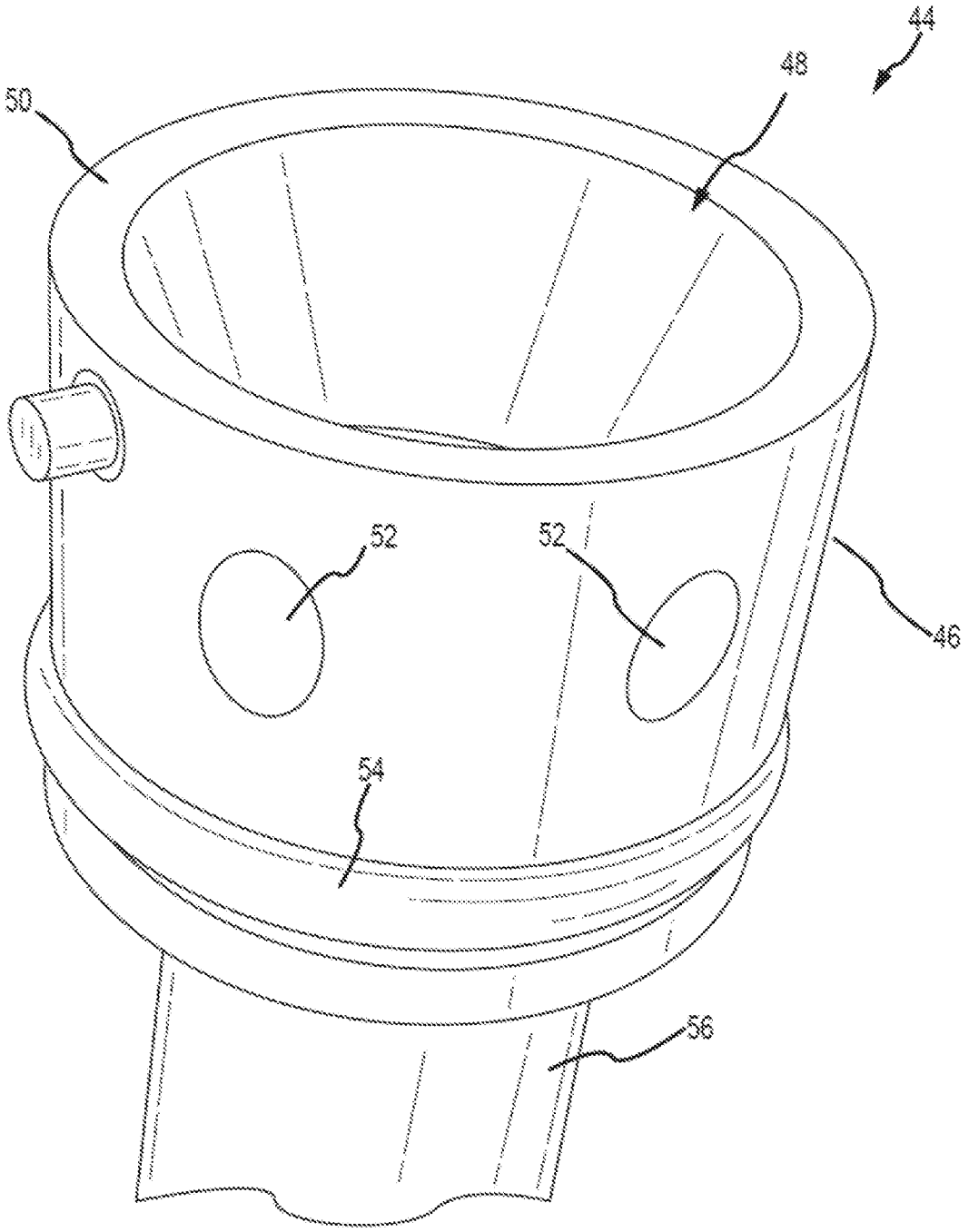
FIG. 3A is a perspective view of a holder and a portion of a coating tube.

Referring now to FIG. 3A, the holders 44 include an opening 48. When a holder 44 is positioned in a tray 42, the opening 48 is oriented to face upwardly toward the carriage 8. Optionally, the opening 48 has a conical or funnel shape configured to direct a second end 20 of a workpiece 14 into a coating tube 56.

The lumen 58 of the coating tube 56 has an interior diameter that is at least equal to the exterior diameter of the workpiece 14. In one embodiment, the lumen has an interior diameter of approximately 0.375 inches. In other embodiments, the interior diameter of the lumen is less than approximately 0.5 inches. Optionally, in another embodiment, the lumen interior diameter is between approximately 0.030 inches to approximately 0.75 inches. In some embodiments, the lumen has a width or diameter that can be at least 5% greater than the outer width or diameter of the workpiece. In some embodiments, the lumen has a width or diameter that can be between about 10-90% of the outer width or diameter of the workpiece.

In one embodiment, the holders 44 include a body 46 that is generally cylindrical. The body 46 has an upper lip 50 over which the fluid in the tray 42 may flow to fill the tube lumen 58. Additionally, one or more apertures 52 may optionally be formed through the holder body 46. The apertures 52 are configured to allow a fluid FA, FB to flow into, and out of, a coating tube 56 associated with a holder 44. In one embodiment, the apertures 52 can extend through an exterior surface of the body 46 a predetermined distance from the upper lip 50. In this manner, when a holder 44 is received in a tray 42, the apertures 52 are a predetermined distance above the base 36 of the tray. In one embodiment, generally illustrated in FIG. 2, an aperture 52 of a holder 44 may be positioned substantially level with the tray base 36. Any Fluid F added to the tray may thus flow directly into a coating tube 56 through an aperture 52.

The holders 44 are configured to be removably sealed to the trays 42. In this manner, holders and associated coating tubes 56 may be removed for replacement and/or cleaning. The holder 44 may optionally include an element 54 to form a seal with a tray 42. In one embodiment, the seal element 54 is an o-ring. The body 46 may include a recessed channel to receive the seal element 54.

The coating tubes 56 may have any length and diameter. In one embodiment, the lumen has a length at least equal to a length of the workpiece 14. In another embodiment, the length of the lumen 58 is up to approximately 300 cm. Optionally, the length of the lumen 58 is up to approximately 200 cm. Additionally, or alternatively, in another embodiment the lumen 58 has a length sufficient to coat up to approximately 175 cm of the length of a workpiece. In one embodiment, the lumen 58 has a length sufficient to coat at least 10 percent of a length of a workpiece. In an embodiment, the length of the lumen 58 can be sufficient to coat at least 20 percent of the length of the workpiece. The length of the lumen 58 may be sufficient to coat approximately 100 percent of the length of the workpiece. In another embodiment, the length of the lumen 58 can be between approximately 10 percent and approximately 100 percent of the length of the workpiece.

In another embodiment, the length of a coating tube 56 and its lumen 58 can be less than a length of a workpiece 14. By selecting a coating tube 56 that is shorter than a workpiece 14, the size of the coating apparatus 2 is beneficially decreased. A coating tube 56 that is shorter than a workpiece 14 may also require less fluid F to coat a predetermined portion of the workpiece, decreasing waste and spoilage of the fluid.

In one embodiment, as the workpiece 14 is lowered into the lumen 58 that is shorter than the workpiece, a distal or second end 20 of the workpiece may contact a closed end 57 of the coating tube 56. In one embodiment, the coating tube 56 may be configured to re-direct or bend the second end 20 of the workpiece 14 upwardly within the lumen 58. As the carriage 8 moves closer to the dip block 30, the workpiece 14 may bend into a "U" shape with the second end 20 moving upwardly toward the dip block 30. In one embodiment, to facilitate the upward redirection of the second end of the workpiece, the lumen 58 may have an interior diameter that is at least approximately 200 percent of the exterior diameter of the workpiece. In another embodiment, the interior diameter of the lumen may be between approximately 200 percent and approximately 300 percent of the workpiece exterior diameter.

Additionally, or alternatively, in another embodiment the workpiece 14 can bunch within the lumen 58 when the carriage 8 continues to move toward the dip block 30 after the second end 20 of the workpiece 14 contacts the closed end 57. The bunching of the workpiece 14 can begin proximate to the closed end 57 of the coating tube and continue upwardly towards the dip block 30 as the carriage 8 continues moving downwardly. In this embodiment, the lumen 58 has an interior diameter that is at least two times the exterior diameter of the workpiece 14. Optionally, the lumen 58 has an interior diameter that is at least about 120 percent or, in some embodiments, from approximately 200 percent to approximately 600 percent of the workpiece exterior width or diameter to facilitate bunching of the workpiece with the lumen.

In one embodiment, the length of the lumen 58 of the coating tubes 56 may be adjustable. In this manner less fluid F is required to fill a coating tube to coat a predetermined length of a workpiece 14. For example, in an embodiment in which the coating tube 56 has a length that is greater than a length of a portion of the workpiece 14 that requires coating, the lumen 58 may be selectively closed or nipped. Optionally, the coating tubes 56 may be formed of a material that is one or more of flexible and bendable. Accordingly, a length of a lumen 58 may be altered by at least one of bending, clamping, collapsing, or twisting a selected portion of a coating tube 56. In one embodiment, the length of the lumen 58 may be altered by 10%, 20%, 30%, 40%, 50%, 60%, 70%, 80%, 90%, or 100%.

Referring now to FIG. 2, the coating apparatus 2 may optionally include an adjustment element 88A operable to alter the length of a lumen 58 of a coating tube 56. The adjustment element 88A may be moveable along a length of an associated coating tube 56. In one embodiment, the adjustment element 88A is configured to close a selected portion of the lumen. For example, the adjustment element may close the lumen by at least one of folding, pinching, compressing, twisting, and clamping a selected portion of a coating tube. In one embodiment, the adjustment element 88A comprises a clamp, a valve, and the like. In another embodiment, the adjustment element 88A is operable to apply a force to a selected portion of a coating tube such that interior surfaces of the coating tube are compressed together to form a nip or a restriction. The selected portion may be approximately 10%, 20%, 30%, 40%, 50%, 60%, 70%, 80%, 90%, or 100% of the length of the coating tube 56 from the distal end 57. The restriction decreases the interior diameter of the lumen 58 by a predetermined amount sufficient to prevent one or more of a fluid F and a workpiece 14 from descending further into the coating tube 56.

In one embodiment, the adjustment element 88A is associated with an actuator 90. The actuator 90 is operable to move the adjustment element 88A to a selected portion of a coating tube 56. In one embodiment, the actuator 90 is operable to move the adjustment element 88A generally vertically as indicated by the arrow 92. Optionally, the actuator 90 may control the position of adjustment elements 88A associated with coating tubes 56 of both the first tray 42A and the second tray 42B as generally illustrated in FIG. 2. Accordingly, in one embodiment of the present invention, the coating apparatus 2 only requires one actuator 90. However, in another embodiment, the coating apparatus 2 may include a first actuator to move adjustment elements associated with coating tubes 56 extending from the first tray 42A. A second actuator may be provided to move the adjustment elements associated with coating tubes 56 extending from the second tray 42B. In one embodiment, the adjustment element 88A and the actuator 90 may be controlled by signals received from the control system 110.

Figure 3B:
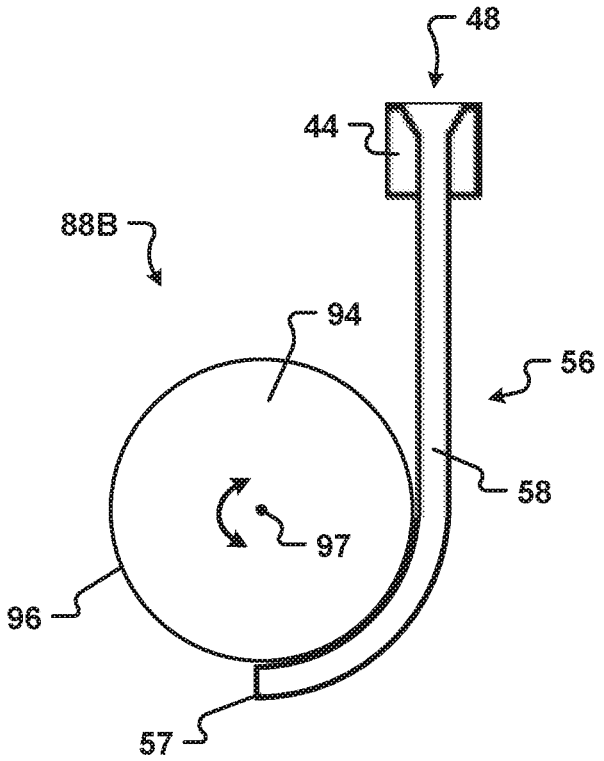
FIG. 3B is a side elevation view of a take-up spool of one embodiment of the present invention that may operate to alter a length of a lumen of a coating tube.

Referring now to FIG. 3B, another embodiment of an adjustment element 88B is generally illustrated. The adjustment element 88B includes a take-up spool 94 associated with a coating tube 56. The take-up spool 94 includes an exterior surface 96. In one embodiment, the exterior surface 96 has a shape that is generally cylindrical. A distal end 57 of the coating tube 56 may be fixed to the exterior surface 96. The take-up spool 94 is operable to around an axis 97 to selectively wind the coating tube 56 around the exterior surface 96. In one embodiment, the take-up spool 94 can "reel in" or "reel out" an associated coating tube 56 in response to a signal received from the control system 110. As the take-up spool 94 rotates and winds the coating tube 56, the coating tube collapses and a lumen 58 of the coating tube is closed, or nipped shut, effectively decreasing the length of the lumen. Optionally, the adjustment element 88B may selectively decrease the length of the lumen 58 by between approximately 5% and approximately 100%.

Figure 3F:
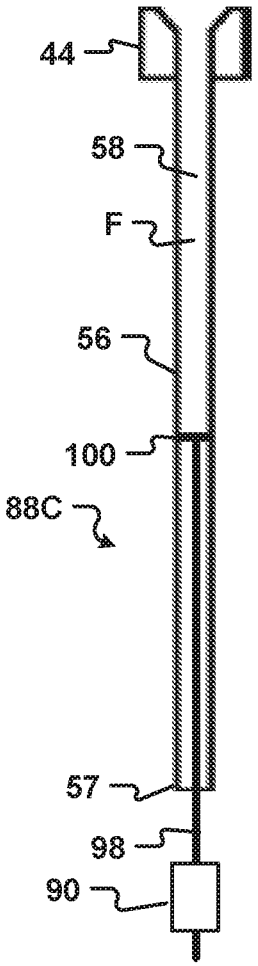
FIG. 3F is a side elevation view of a coating tube including a plunger operable to reduce a volume of the coating tube.

Referring now to FIG. 3F, another embodiment of an adjustment element 88C is generally illustrated. The adjustment element 88C comprises a shaft 98 extending through a closed end 57 of a coating tube 56. A head 100 with a geometry to seal an interior of a lumen 58 of the coating tube 56 is interconnected to the shaft 98. The shaft 98 and head 100 generally define a plunger operable to alter the length or volume of the lumen 58. In one embodiment, the adjustment element 88C may move along a length of the coating tube 56 in response to a signal received from the control system 110. The adjustment element 88C may decrease the volume of the lumen 58 by between approximately 1% and approximately 100%.

Referring again to FIGS. 1-2, a fluid circulating system 70 is associated with each of the trays 42A, 42B. Each fluid circulating system 70 has a reservoir 72 for one of the fluids FA, FB. The reservoir 72 includes a plurality of conduits 78, 82, 86 interconnected to the tray 42.

In one embodiment, a first conduit 78 is associated with a pump 80 to move fluid F from a reservoir 72 to a tray 42. In one embodiment, the pump 80 is actuated by a control system 110. The pump may optionally be pneumatic. Optionally, the pump 80 includes a flow meter. The flow meter is operable to measure one or more of a rate and a volume of the fluid F that flows through the pump 80. The control system 110 can selectively activate the pump 80 such that a fluid F is pumped into the tray 42 to a predetermined level. Additionally, or alternatively, the control system 110 may stop the pump 80 when the flow meter indicates that a predetermined volume of fluid has moved through the pump. In this manner, the control system 110 can selectively actuate the pump 80 to fill a tray 42 with a predetermined level of fluid F or a predetermined volume of the fluid.

The rate at which the pump 80 moves the fluid may be set by the control system 110. In one embodiment, when the fluid F is above the upper lip 50 of a holder 44 or the optional aperture 52, the fluid flows into the coating tube 56.

In one embodiment, the control system 110 can automatically activate the pump 80 to fill a tray 42 with fluid when the tray is in the filling position and is not in the dipping position. For example, the dip block 30 illustrated in FIG. 1 is aligned with the workpieces such that the first tray 42A is in the dipping position and the second tray 42B is in a filling position which is not the dipping position. Accordingly, the control system 110 can automatically activate the pump 80B until the second fluid FB reaches the predetermined level in the second tray 42B.

A sensor 66 is associated with each tray 42. In one embodiment, the sensor is operable to determine a height of a surface of the fluids F relative to the base 36 of the dip block 30. More specifically, in one embodiment the sensor 66 can measure the level of a fluid F in a tray 42. The sensor 66 measures a position of the surface of the fluid F and transmits the position to the control system 110.

Optionally, the sensor 66 may measure a distance to an upper surface 59 of a fluid F within a lumen 58 of a coating tube 56. In this manner, the coating tube 56 may be only partially filled with fluid. For example, in FIG. 1, sensor 66B is positioned to record a position of an upper surface 59 of a second fluid FB with a coating tube 56 interconnected to the second tray 42B. As the pump 80B transmits or pumps the second fluid FB into the second tray 42B, the second fluid will flow into all of the coating tubes 56 extending downwardly from the second tray. When the fluid upper surface 59 is at a predetermined distance from a closed or distal end 57 of the coating tube, the control system 110 can send a signal to stop the pump 80B. In this manner, very little or none of the second fluid 80B will be retained in the second tray 42B.

The control system 110 may send a signal to the pump 80 to pump a predetermined volume of fluid into a tray 42 to fill each of the coating tubes 56 interconnected to the tray to a predetermined level. In one embodiment, the control system 110 can cause the pump 80 to pump a sufficient amount of fluid F into the tray such that the fluid flows from the tray into the coating tubes 56 and fills each of the coating tubes to approximately 10% of the length of the coating tube as measure from the distal end 57. In another embodiment, the control system 110 can cause the pump 80 can fill the coating tubes with approximately 20%, 30%, 40%, 50%, 60%, 70%, 80%, 90%, or 100% of the fluid F. By filling less than 100% of a coating tube 56 with fluid, less of the fluid will be displaced from the lumen 58 into the tray 42 as the workpiece 14 is lowered into the lumen. In this manner, the coating apparatus 2 of the present invention may prevent spoilage and waste of fluid and use less fluid than prior art coating apparatus. Furthermore, the amount of fluid in the coating tube 56 can account for displacement of the fluid such that the workpiece 14 can be coated to the desired level. In other words, the fluid in the coating tube can account for the displacement of the fluid to provide the desired level of the coating to the workpiece 14.

Figure 3C:
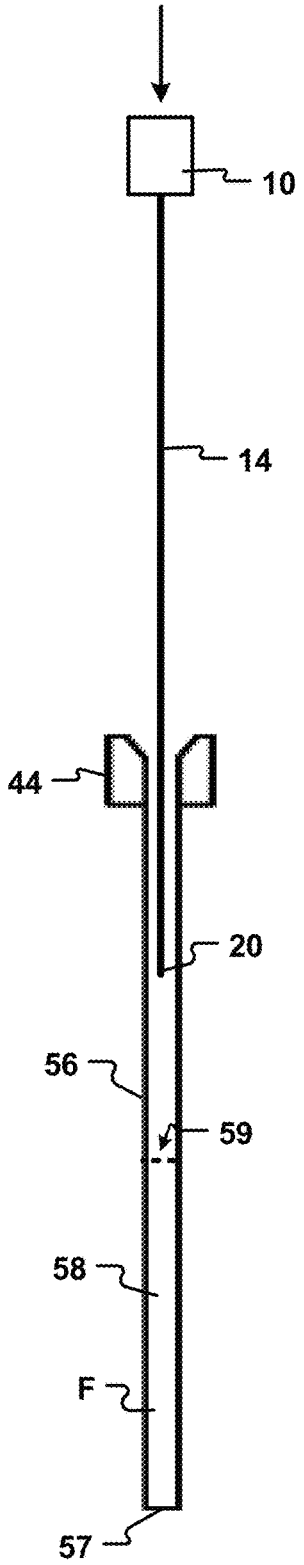
FIG. 3C is a side elevation view of a coating tube filled with a predetermined volume of a fluid.
Figure 3D:
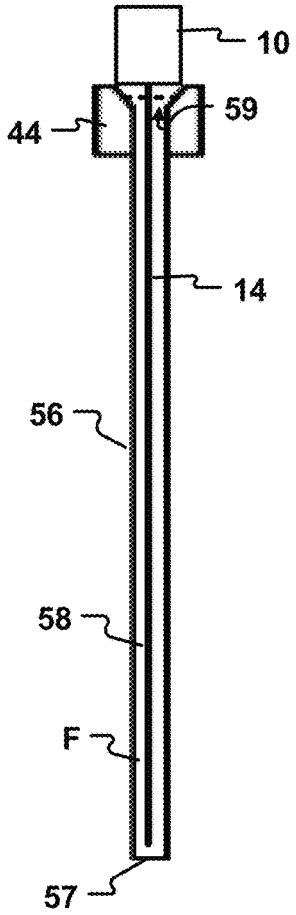
FIG. 3D is another side elevation view of the coating tube of FIG. 3C illustrating a change in an upper surface of the fluid as a workpiece is lowered into a lumen of the coating tube.
Figure 3E:
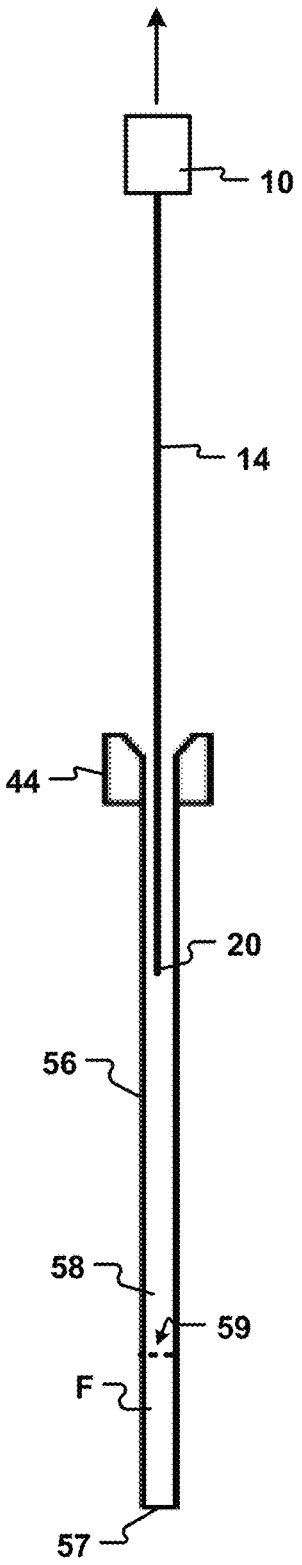
FIG. 3E illustrates the coating tube of FIG. 3D after the workpiece is withdrawn from the fluid causing an upper surface of the fluid to drop within the lumen.

In one embodiment, the control system 110 can send a signal to a pump 80 to move a sufficient amount of fluid F into a tray 42 to fill coating tubes interconnected to the tray by a predetermined amount based on a ratio of an exterior diameter of a workpiece 14 and interior diameter of a lumen of a coating tube. In this manner, the control system 110 can fill the coating tube with a sufficient amount or volume of fluid F to coat a predetermined length of the workpiece 14 without displacing any of the fluid F from the lumen 58 into the tray 42. More specifically, and referring now to FIG. 3C, a coating tube 56 is generally illustrated partially filled with a fluid F to a predetermined level. More specifically, the coating tube 56 is less than approximately 90% filled with the fluid F. When a workpiece 14 is lowered into the lumen 58, the level of an upper surface 59 of the fluid F will rise within the coating tube. However, the initial volume of fluid F in the coating tube can be selected such that when a desired length of the workpiece 14 is within the lumen, as generally illustrated in FIG. 3D, the upper surface 59 of the fluid F will not rise above an aperture 52 or an upper lip 50 of a holder 44. Accordingly, the fluid F will not flow out of the coating tube and into a tray 42. Referring now to FIG. 3E, when the workpiece 14 is withdrawn from the fluid F, the fluid upper surface 59 will drop towards the distal end 57 of the coating tube 56. The control system 110 may subsequently activate the pump 80 to transport more of the fluid F to the coating tube 56 until the fluid upper surface 59 is at the predetermined level as generally illustrated in FIG. 3C.

In one embodiment, the sensor 66 is configured to move with respect to tray 42. Accordingly, the sensor 66 can move into a position to measure an upper surface 59 of fluid F in a tray 42 or within a lumen 58 of a coating tube 56. Referring again to FIG. 1, the sensor 66A is illustrated in a first position to sense the upper surface 59 of the first fluid FA in the first tray 42A according to one embodiment of the present invention. Accordingly, the sensor 66A is in a position that does not obstruct movement of a workpiece into a coating tube 56 of the first tray. The sensor 66B is illustrated in a second position to sense the upper surface of the second fluid FB in a coating tube of the second tray 42B. Optionally, the sensor 66 may be configured to move laterally, pivot, or otherwise move between one or more of the first and second positions.

In one embodiment, the sensor 66 is a fiber optic fluid level sensor. However, other sensors operable to determine a position or height of the surface 59 of a fluid in a tray or within a lumen 58 may be used with the coating apparatus 2 of the present invention. In another embodiment, the sensor 66 operates at a low voltage. In one embodiment, the sensor 66 is oriented approximately parallel to the surface of the fluid. Other locations and orientations of the sensor 66 are contemplated for use with the coating apparatus.

Referring now to FIG. 2, optionally, in one embodiment an adjustment conduit 79 may be connected to a holder 44 or a coating tube 56. Optionally, the adjustment conduit 79A may be interconnected to an upper portion of the coating tube 56 or to the holder 44. In another embodiment, the adjustment conduit 79B is interconnected to the coating tube 56 proximate to a distal or closed end 57.

An adjustment conduit 79 may be associated with each holder 44 or coating tube 56. In this manner, the fluid circulating system 70 can move fluid F directly into a lumen 58 of a coating tube 56. The adjustment conduit 79 enables filling of only a portion of the length of a coating tube. In one embodiment, the pump 80 is a two-way pump. Accordingly, in one embodiment, the adjustment conduit 79B may operate with the pump 80A to add fluid to and withdraw fluid from a coating tube. In this manner, the control system 110 may use the pump 80A and the adjustment conduit 79 to adjust or maintain a level of the first fluid FA in the coating tubes 56 interconnected to the first tray 42A.

Only one fluid circulating system 70A associated with the first tray 42A is illustrated in FIG. 2. However, a second fluid circulating system that is the same as or similar to the first fluid circulating system 70A may be associated with the second tray 42B and the coating tubes 56 extending from the second tray. Optionally, multiple circulating systems 70A can be associated with the first tray 42A or the second tray 42B.

The control system 110 may send a signal to the pump 80A to move a predetermined volume of fluid through the adjustment conduit 79 into or out of one or more of the coating tubes 56 associated with the first tray 42A. In one embodiment, the control system 110 can cause the pump 80A to pump a sufficient amount of the first fluid FA into a coating tube 56 to fill approximately 10% of the coating tube as measure from the distal end 57. In another embodiment, the pump 80A can fill the coating tube with approximately 20%, 30%, 40%, 50%, 60%, 70%, 80%, 90%, or 100% of the first fluid FA. By filling less than 100% of a coating tube 56 with fluid, less of the fluid will be displaced from the lumen into the tray 42A as the workpiece 14 is lowered into the lumen. In this manner, the coating apparatus 2 of the present invention may prevent spoilage and waste of fluid and use less fluid than prior art coating apparatus. In another embodiment, the control system can send a signal to the pump 80A to drain or withdraw some or all of the first fluid FA from the coating tubes 56.

In one embodiment, the control system 110 can use the adjustment conduit 79 to fill a coating tube by a predetermined amount based on a ratio of an exterior diameter of a workpiece 14 and interior diameter of a lumen of a coating tube. In this manner, the control system 110 can fill the coating tube with a sufficient amount of fluid FA to coat a predetermined length of the workpiece 14 without displacing any of the first fluid FA from the lumen 58 into the tray 42A, such as generally describe in conjunction with FIGS. 3C-3E.

A second conduit 82 that is interconnected to a tray 42 and a valve 84 is operable to selectively drain fluid F from the tray 42 into the reservoir 72. The control system 110 can send signals to the valve 84 to open and close the valve. In one embodiment, the control system 110 will open the valve 84 if a fluid F in a tray exceeds a predetermined level. Additionally, or alternatively, the valve 84 may be manually actuated. Any suitable valve 84 may be used with the coating apparatus 2 of the present invention. In one embodiment, the valve 84 a pneumatic valve. Optionally, fluid can be recirculated between a tray 42 and a reservoir 72 by opening the valve 84 to release fluid F from the tray while the pump 80 is activated to move F through the first conduit 78 into the tray.

Optionally, in one embodiment, the control system can open the valve 84 after filling the coating tubes 56 to a predetermined level. Excess fluid F may thus be removed from a tray 42 before a workpiece 14 is dipped into the fluid F. For example, when the control system 110 determines a coating tube 56 has a predetermined amount or volume of fluid F, such as generally illustrated in FIG. 3C, the control system may open the valve 84 to drain fluid from a tray associated with the coating tube 56. In this manner, the fluid F is returned to the reservoir 72 without contamination from the workpiece reducing spoilage of the fluid. Draining the fluid F from the tray 42 may also prevent an excessive amount of fluid F from flowing into the coating tube 56. If an excessive amount of fluid F is in the coating tube 56, portions of the workpiece 14 that do not require coating with the fluid, or are not intended to be coated, may inadvertently be coated with the fluid. Coating a greater portion of the length of the workpiece than required may damage the workpiece in use or to remove and uses more of the fluid than required.

In one embodiment, a third conduit 86 is configured as an over-flow drain to keep fluid F in a tray 42 from exceeding a predetermined level. In one embodiment, the third conduit 86 is associated with a drain or weir 60 such as generally illustrated in FIG. 2. As the drive system 6 lowers the carriage 8 towards the dip block 30, workpieces 14 move into the coating tubes 56 displacing fluid F from the coating tubes. As generally illustrated in FIG. 1, this causes the level of fluid FA to increase in the first tray 42A and flow through the third conduit 86A back to the fluid reservoir 72A.

Additionally, or alternatively, in one embodiment the control system 110 may open the valve 84 when workpieces are lowered into the coating tubes 56. The open valve 84 will drain excess fluid F from the tray 42 as fluid F is displaced from the coating tubes 56.

The reservoir 72 may optionally include fluid conditioning equipment such as one or more of an agitator, a heater, a cooler, a vent, and a filter. Optionally, the reservoir may include a sensor operable to measure at least one of a viscosity and a temperature of the fluid. At least one level sensor may be associated with the reservoir 72. In one embodiment, the at least one level sensor comprises a full level sensor 74 and a low level sensor 76. In one embodiment, the control system 110 can send an alert when the low level sensor 76 indicates the reservoir is getting low on fluid F. Additionally, or alternatively, the control system 110 may stop the operation of the coating apparatus 2 if the control system determines that one of the reservoirs 72 does not have a sufficient volume of fluid F to refill an associated tray 42 with fluid to a predetermined level. When the fluid F in a reservoir 72 is below the level of the low level sensor 76, an operator may refill the reservoir with additional fluid.

Figure 4:
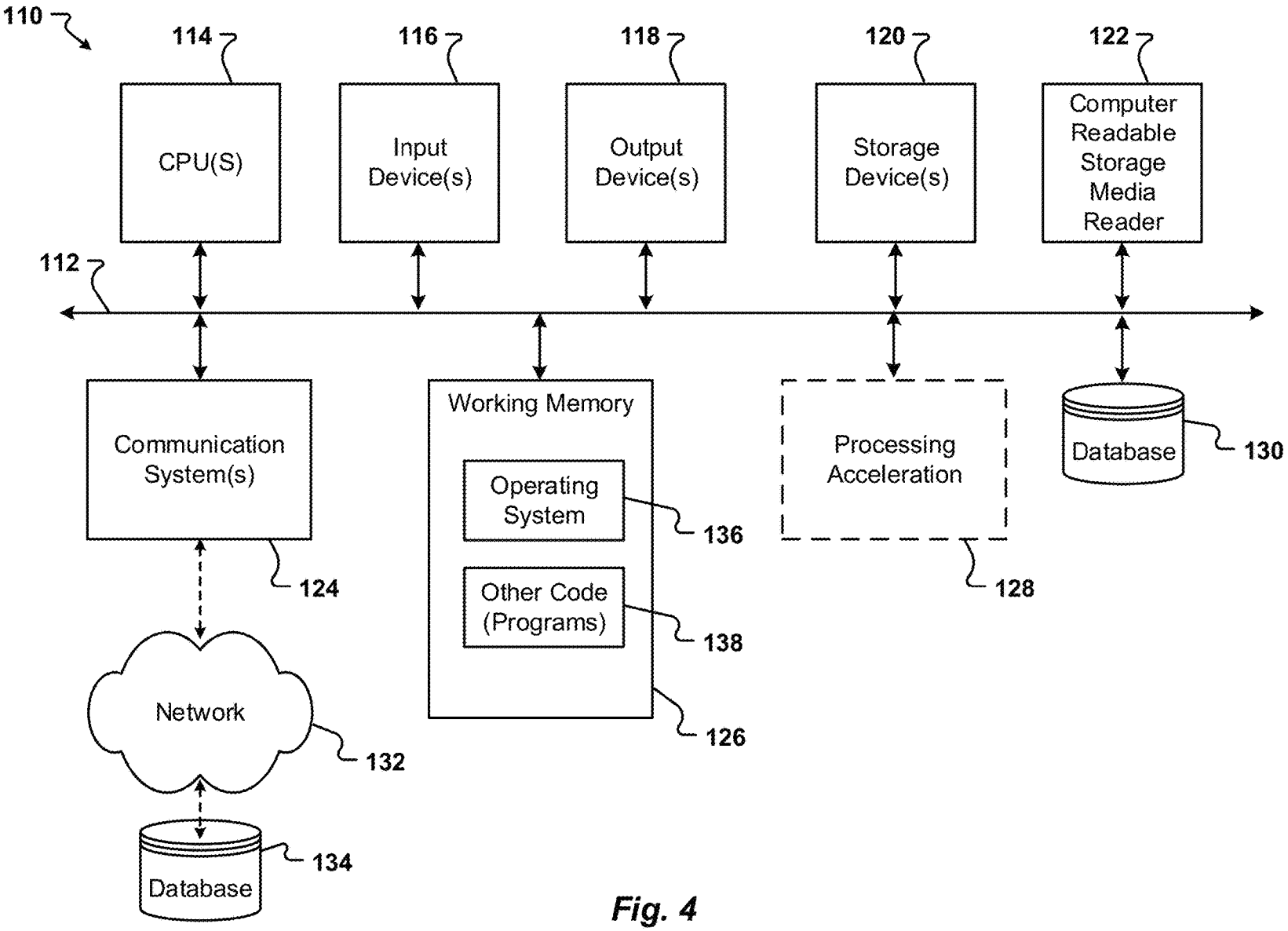
FIG. 4 is a block diagram of an embodiment of a control system of the present invention which is operable to control the coating apparatus.

Referring now to FIG. 4, a control system 110 of one embodiment of the present invention is generally illustrated. More specifically, FIG. 4 generally illustrates one embodiment of a control system 110 of the present invention operable to control the coating apparatus 2. The control system 110 is generally illustrated with hardware elements that may be electrically coupled via a bus 112. The hardware elements may include a central processing unit (CPU) 114; an input device 116 (e.g., a mouse, a keyboard, etc.); and an output device 118 (e.g., a display device, a printer, etc.). The control system 110 may also include a storage device 120. In one embodiment, the storage device(s) 120 may be disk drives, optical storage devices, solid-state storage device such as a random access memory ("RAM") and/or a read-only memory ("ROM"), which can be programmable, flash-updateable and/or the like.

The control system 110 may additionally include one or more of a computer-readable storage media reader 122; a communications system 124 (e.g., a modem, a network card (wireless or wired), an infra-red communication device, etc.); and working memory 126, which may include RAM and ROM devices as described above. In some embodiments, the control system 110 may also include a processing acceleration unit 128, which can include a DSP, a special-purpose processor and/or the like. Optionally, the control system 110 also includes a database 130.

The computer-readable storage media reader 122 can further be connected to a computer-readable storage medium, together (and, optionally, in combination with storage device(s) 120) comprehensively representing remote, local, fixed, and/or removable storage devices plus storage media for temporarily and/or more permanently containing computer-readable information. The communications system 124 may permit data to be exchanged with a network 132 and/or any other data-processing. Optionally, the control system 110 may access data stored in a remote storage device, such as database 134 by connection to the network 132. In one embodiment, the network 132 may be the internet.

The control system 110 may also comprise software elements, shown as being currently located within the working memory 126. The software elements may include an operating system 136 and/or other code 138, such as program code implementing one or more methods and aspects of the present invention.

One of skill in the art will appreciate that alternate embodiments of the control system 110 may have numerous variations from that described above. For example, customized hardware might also be used and/or particular elements might be implemented in hardware, software (including portable software, such as applets), or both. Further, connection to other computing devices such as network input/output devices may be employed.

Suitable control systems 110 are known to those of skill in the art. In one embodiment, the control system 110 is a personal computer, such as, but not limited to, a personal computer running the MS Windows operating system. Optionally, the control system 110 may be a smart phone, a tablet computer, a laptop computer, and similar computing devices. In one embodiment, the control system 110 is a data processing system which includes one or more of, but is not limited to: an input device (e.g. a keyboard, mouse, or touch-screen); an output device (e.g. a display, a speaker); a graphics card; a communication device (e.g. an Ethernet card or wireless communication device); permanent memory (such as a hard drive); temporary memory (for example, random access memory); computer instructions stored in the permanent memory and/or the temporary memory; and a processor. In another embodiment, the control system 110 is a programmable logic controller (PLC). One example of a suitable PLC is a Controllogix PLC produced by Rockwell Automation, Inc, although other PLCs are contemplated for use with embodiments of the present invention.

Figure 5:
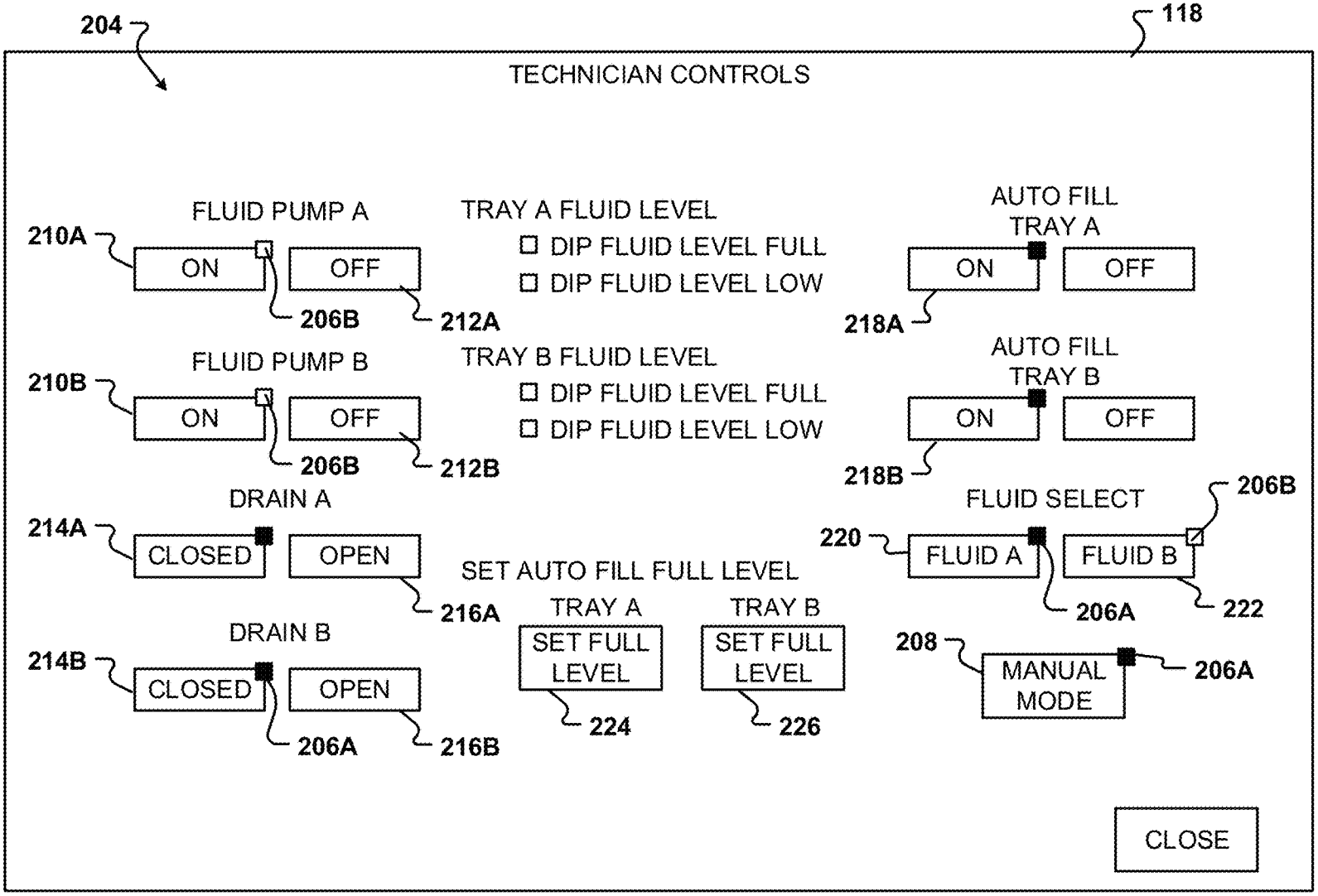
FIG. 5 is a user interface generated by the control system according to one embodiment of the present invention.

Referring now to FIG. 5, an embodiment of one user interface 204 generated by the control system 110 is generally illustrated. The user interface 204 may be used by an operator to set a level of a fluid F in a tray 42 and/or a coating tube 56 of the coating apparatus 2. The operator can set a fill level for a fluid F with user interface 204 when a change is made to the coating apparatus 2, such as a change to one or more of the fluids FA, FB, when the coating tubes 56 are changed, or before a new type of workpiece is to be coated. An output device 118 of the control system 110 may display the user interface 204.

The user interface generally includes buttons which are selectable by the operator to control the pumps 80 and valves 84 to set a fluid fill level in the trays 42 and/or the coating tubes 56. Some of the buttons include an icon 206 operable to indicate when a button has been selected. For example, the icon may change appearance, such as by lighting and/or blinking when an associated button is selected, as indicated by icon 206A.

To set a fluid fill level, the operator can select the manual mode button 208. The auto fill tray A button 218A and auto fill tray B button 218B are then selected. To set the fluid level in the first tray 42A, the operator will also select buttons 214A, 214B to close valves 84A, 84B to prevent fluid from draining from the trays 42. The operator also selects one of the fluid select buttons 220, 222 to set the fluid fill level for the other tray 42B, 42A. More specifically, as described in conjunction with FIGS. 1-2, in one embodiment, the control system 110 will only auto fill the fluid F in a tray 42 when the tray is not in the dipping position aligned with the workpieces 14 suspended from the carriage 8. More specifically, in the embodiment illustrated in FIG. 1, the second tray 42B is not in the dipping position and the control system 110 can automatically fill the fluid FB into the second tray 42B.

Accordingly, to set the auto fill level for the second fluid FB, the second tray 42B may not be in the dipping position. The operator may move the second tray 42B out of the dipping position by selecting the fluid A select button 220. In the example user interface 204 illustrated in FIG. 5, fluid select button 220A has been selected as indicated by icon 206A such that the automatic fill level for the second tray 42B may be set. When the fluid select button 220A is selected, the control system 110 can activate the drive element 38, if necessary, to move the first tray 42A into the dipping position and the second tray 42B into the filling position.

The operator can then select the button 210B to activate the second fluid pump 80B. In response, the control system 110 will activate the second pump 80B and transfer the second fluid FB from the second reservoir 72B to the second tray 42B. When a predetermined level of the second fluid FB is in the second tray 42B, the operator can select the off button 212B to deactivate the second pump 80B. The predetermined level is generally below the weir 60B. In one embodiment, the predetermined level is above the apertures 52 of the holders 44 of the coating tubes. Alternatively, in another embodiment, the predetermined level is above the upper lip 50 of the holders 44.

In one embodiment, the sensor 66 may be in the second position to measure the position of the fluid upper surface 59 within a coating tube 56 when the operator sets the fill level. Accordingly, the operator can select the off button 212B to deactivate the second pump 80B when a predetermined level of the second fluid FB is within the coating tube 56. Optionally, the volume of fluid F pumped into the tray 42 through the first conduit 78 or directly into the coating tube 56 through the adjustment conduit 79 is selected to only partially fill the coating tubes 56. For example, the operator may cause the pump 80 to transport a sufficient volume of fluid F to fill the coating tubes by approximately 50 percent as generally illustrated in FIG. 3C. Additionally, or alternatively, the coating tubes and be filled to 10%, 20%, 30%, 40%, 50%, 60%, 70%, 80%, 90%, or 100% according to embodiments of the present invention.

If the second tray 42B is too full and the second fluid FB is above the predetermined level, the operator may activate the second drain valve 84B by selecting the open second valve button 216B. When the operator selects the open second valve button 216B, the control system 110 will open the second valve 84B associated with the second conduit 82B and allow the second fluid FB to flow from the second tray 42B. When the second fluid FB reaches the predetermined level, the operator can select the close second valve button 214B to close the second valve 84B. Optionally, the control system 110 may send a signal to a pump 80B to withdraw the second fluid FB from the coating tubes 58 of the second tray 42B through the adjustment conduit 79.

When the predetermined level of the second fluid FB is in the second tray 42B or within the coating tubes 56 associated with the second tray 42B, the operator may select the set full level button 226. The control system 110 will subsequently operate the second pump 80B to keep the second fluid FB at the predetermined level in the second tray or within the coating tubes 56 when the second tray 42B is not in the dipping position. For example, in one embodiment the control system may automatically add fluid to the second tray or directly to the coating tubes or withdraw fluid from the second tray or the coating tubes to automatically maintain the second fluid FB at the predetermined level.

In one embodiment, the control system 110 records a volume of fluid that has passed through the pump 80B as the operator sets the full level for the second tray. The volume may be measured by a flow meter associated with the pump 80B. Accordingly, in one embodiment, the control system 110 can send a signal to the pump 80B to pump the volume of fluid to the second tray to refill the second tray 42B to the predetermined level.

The auto fill level for the first tray 42A may be set in the same or a similar manner. More specifically, the operator may select the fluid select B button 222 to ensure the first tray is not in the dipping position. The operator can then activate the first pump 80A with the fluid pump on button 210A and optionally open the first valve 84A with the open first valve button 216A until the first fluid FA is at the predetermined level. The operator may then select the set full level button 224 for the first tray.

Figure 6:
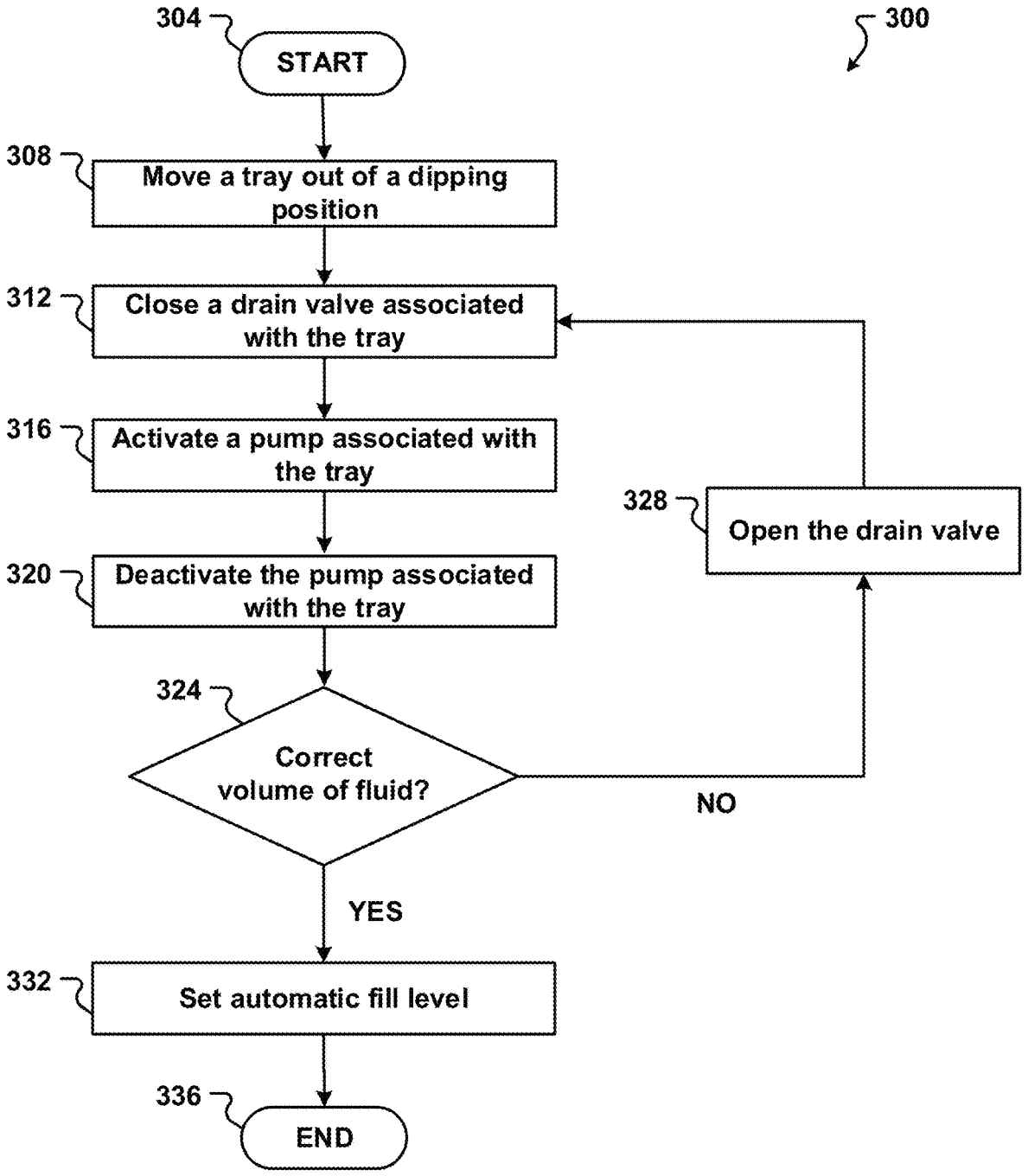
FIG. 6 is a process diagram of a method of setting an automatic fill level for a tray of the coating apparatus according to one embodiment of the present invention.

Referring now to FIG. 6, an embodiment of a method 300 for setting an automatic fill level for a fluid tray 42 and/or a coating tube 56 of a coating apparatus 2 according to one embodiment of the present invention is generally illustrated. While a general order of the method 300 is shown in FIG. 6, it will be understood by one of skill in the art that the method 300 can include more or fewer operations and can arrange the order of the operations differently than those shown in FIG. 6. Although the operations of the method may be described sequentially, many of the operations may in fact be performed in parallel or concurrently. Generally, the method 300 starts with a start operation 304 and ends with an end operation 336. The method 300 can be executed as a set of computer-executable instructions executed by a computer system and encoded or stored on a computer readable medium. One example of the computer system may include, for example, the control system 110 which is generally illustrated and described in conjunction with FIG. 4. An example of the computer readable medium may include, but is not limited to, a memory 120, 126 of the control system 110. Hereinafter, the method 300 shall be explained with reference to the coating apparatus 2 and components described in conjunction with FIGS. 1-5.

In operation 308, a tray 42 to be filled with a fluid is moved into a filling position (or out of the dipping position). In one embodiment, an operator may select a button 220 or 222 in user interface 204 to move one of the trays 42 out of the dipping position. For example, by selecting the fluid A button 220, the drive element 38 will move the dip block 30 such that the first tray 42A is in the dipping position and the second tray 42B can be automatically filled. In one embodiment, the output device 118 is touch sensitive such that selecting the button 220 comprises touching the user interface 204.

In operation 312, a drain valve 84 associated with the tray 42 to be filled is closed. The operator may manually close the drain valve. Additionally, or alternatively, in one embodiment the operator can select a button 214 in user interface 204 to close the drain valve 84.

In operation 316, a pump 80 is activated to add a fluid F to the tray 42. In one embodiment, the pump 80 is activated in response to a signal received from the control system 110 when the operator selects a button 210A, 210B in user interface 204.

When the fluid F in the tray 42 or within a coating tube 56 reaches a predetermined level, the pump 80 is deactivated in operation 320. As described in conjunction with FIG. 5, in one embodiment of the present invention the operator can deactivate the pump by selecting a button 212 in user interface 204. After the operator selects the button 212, the control system 110 will send a signal to the pump 80 configured to stop the pump.

In operation 324, the operator determines if a correct volume of fluid F is in the tray 42 or the coating tube 56. Data from the sensor 66 may be used to determine a position of a fluid upper surface 59 within the tray 42 and the coating tube 56. In one embodiment, the coating tube 56 can be filled to 10%, 20%, 30%, 40%, 50%, 60%, 70%, 80%, 90%, or 100%.

If a correct volume of fluid is in the tray 42 and/or the coating tube 56, the method 300 continues YES to operation 332. If an incorrect volume of fluid is in the tray (for example, too much fluid or too little fluid), the method 300 proceeds NO to operation 328.

In operation 328, the operator may optionally open a drain valve 84 to reduce the volume of fluid F in the tray 42. The drain valve 84 can be opened by selecting one of the open drain buttons 216 in user interface 204. Additionally, or alternatively, the operator can activate the pump 80 to withdraw fluid F from the coating tube 56 through the adjustment conduit 79B. The method 300 may then return to operation 312.

After the correct volume of fluid F is in the tray 42 and/or the coating tube 56, in operation 332 the fill level for the tray 42 can be set. In one embodiment, the operator selects one of the set full level buttons 224, 226 in user interface 204. Optionally, the method may return to operation 308 to set an automatic fill level for another tray. The method 300 may then proceed to END operation 336.

Figure 7:
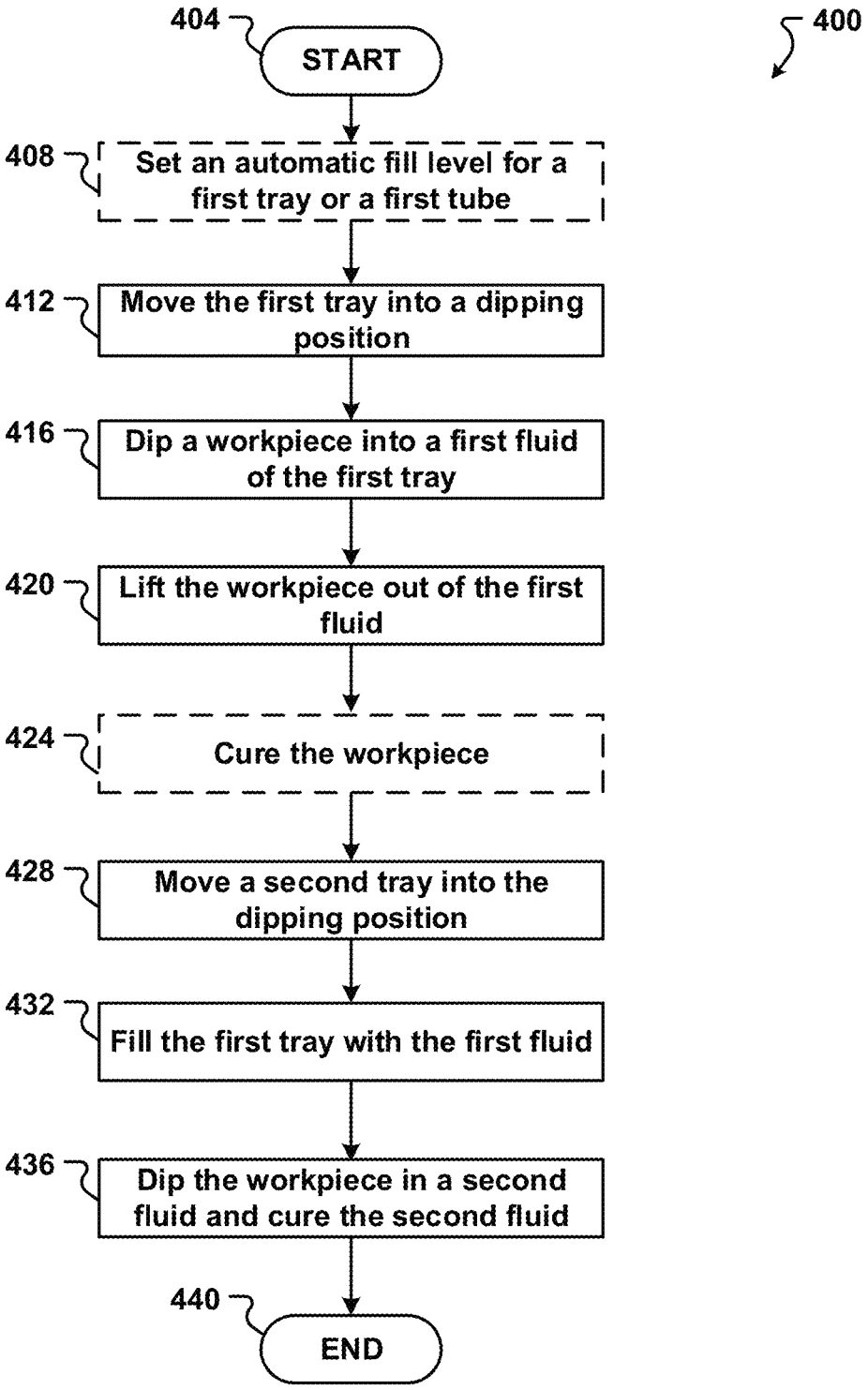
FIG. 7 is another process diagram which generally illustrates a method of operating the coating apparatus.

Referring now to FIG. 7, an embodiment of a method 400 for operating a coating apparatus 2 according to one embodiment of the present invention is generally illustrated. While a general order of the method 400 is shown in FIG. 7, it will be understood by one of skill in the art that the method 400 can include more or fewer operations and can arrange the order of the operations differently than those shown in FIG. 7. Although the operations of the method may be described sequentially, many of the operations may in fact be performed in parallel or concurrently. Generally, the method 400 starts with a start operation 404 and ends with an end operation 440. The method 400 can be executed as a set of computer-executable instructions executed by a computer system and encoded or stored on a computer readable medium. One example of the computer system may include, for example, the control system 110 which is generally illustrated and described in conjunction with FIG. 4. An example of the computer readable medium may include, but is not limited to, a memory 120, 126 of the control system 110. Hereinafter, the method 400 shall be explained with reference to the coating apparatus 2 and components described in conjunction with FIGS. 1-6.

In optional operation 408, the automatic fill level for one or more trays 42 and/or coating tubes 56 of the coating apparatus 2 can be set. In one embodiment, the automatic fill level is set as described in conjunction with at least one of FIGS. 5-6. Optionally, the control system may automatically fill a coating tube 56 with a predetermined volume of fluid F such that no excess fluid flows from the coating tube 56 when a workpiece is lowered into the coating tube as describe in conjunction with FIGS. 3C-3E.

In operation 412, a first tray 42A is moved into a dipping position. When in the dipping position, tube holders 44 and coating tubes 56 associated with the first tray 42A are aligned to receive workpieces 14 suspended from a carriage 8 of the coating apparatus 2. In one embodiment, the drive element 38 may be activated to move a dip block 30 including the first tray 42A into the dipping position.

Thereafter, in operation 416, the workpieces 14 are lowered into the coating tubes 56 of the first tray 42A. This may include actuating the drive system 6 to lower the carriage 8 including the workpieces 14. In one embodiment, the control system 110 sends a signal to the drive system 6 which causes the drive system to lower the carriage. In one embodiment, the control system 110 may adjust the rate of the drive system to lower (or raise) the carriage at a rate of from approximately 0.1 cm/s to approximately 5.0 cm/s.

When the workpieces 14 are lowered into the coating tubes 56 some of the first fluid FA is displaced and may flow into the first tray 42A. If the surface of the first fluid FA exceeds a top edge of a weir 60A of the first tray 42A, the excess first fluid FA will flow through the third conduit 86 to the first fluid reservoir 72A. In one embodiment, the workpieces 14 may sit in the first fluid FA for a predetermined amount of time. Additionally, or alternatively, the securement devices 10 may rotate around a longitudinal axis while the workpieces are immersed in the first fluid.

In operation 420, after the workpieces 14 have been lowered to a point such that a predetermined length of the workpieces is coated with the first fluid, the workpieces are lifted out of the coating tubes 56. For example, in one embodiment, the drive system 6 can raise the carriage 8 by a predetermined amount.

Optionally, in operation 424, the first fluid FA on the workpieces 14 may be cured. Curing the first fluid may include activating a curing element 22. In one embodiment, the curing element 22 emits ultraviolet light of a predetermined wavelength. Curing the first fluid may also include rotating the securement devices 10 to expose all surfaces of the workpieces 14 to energy emitted by the curing element. Additionally, a cover or shutter of the dip block 30 may close. In this manner, the first and second fluids FA, FB in the dip block 30 will not be exposed to the energy from the curing element 22.

In operation 428, a second tray 42B is moved into the dipping position. In one embodiment, the drive element 38 can move the dip block 30 such that the tube holders 44 and coating tubes 56 associated with the second tray 42B are aligned to receive the workpieces 14 suspended from the carriage 8. As previously described, when the second tray 42B is in the dipping position, the first tray 42A can automatically be filled to a predetermined level.

The first fluid FA in the first tray 42A and/or the coating tube 56 is automatically adjusted (i.e. filled, drained, or maintained) to the predetermined level in operation 432. As described above, as the workpieces are lowered into the coating tubes 56 and subsequently withdrawn, the amount of the first fluid FA in the coating tubes and the first tray 42A decreases. The sensor 66A can measure the amount of the first fluid FA in the first tray 42A and/or the coating tube 56 of the first tray 42A and send data to the control system 110. In one embodiment, the sensor 66A can detect a distance between the surface 59 of the first fluid FA and the sensor. In one embodiment, with the distance received from the sensor, the control system can determine the height of the fluid surface above the base 36 of the first tray 42A and optionally within the coating tube 56. If the fluid surface is below the predetermined level, the control system 110 can send a signal to the first pump 80A to add more of the first fluid FA from the reservoir 72A to the first tray 42A or directly into the coating tube 56 through the adjustment conduit 79. Optionally, the control system may automatically fill 10%, 20%, 30%, 40%, 50%, 60%, 70%, 80%, 90%, or 100% of a coating tube 56 with fluid F according to embodiments of the present invention.

In one embodiment, the control system 110 runs the data from the sensor 66 through a low-pass filter. The low-pass filter averages out readings from the sensor 66. In this manner, the control system 110 can send signals to the pump 80 to efficiently fill the first tray 42A. For example, by sending data from the sensor 66 through a low pass filter, the control system can send signals to the pump 80 to fill the first tray 42A without forming waves or filling the first tray above the predetermined level.

In operation 436, the workpiece 14 may by dipped into and out of the second fluid FB in a manner similar to, or the same as, operations 416, 420. The second fluid on the workpiece may also be cured as described in operation 424. After the workpiece 14 is removed from the second fluid FB, the second tray 42B may be moved out of the dipping position. The control system 110 may then automatically adjust (i.e. fill, drain or maintain) the second tray 42B and/or coating tube 56 of the second tray 42B with the second fluid FB as described in operation 432.

After operation 436, method 400 may loop back to operation 412 to provide one or more additional coats of the first and second fluids FA, FB to the workpiece 14. In one embodiment, the method 400 may repeat for up to 7 cycles to provide fourteen coats of fluid on the workpieces. In another embodiment, the workpiece may receive up to ten coatings of fluid (five coats of the first fluid and five coats of the second fluid). After a predetermined number of cycles, the method 400 proceeds to the END operation 440.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiment described hereinabove is further intended to explain the best mode known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

While the exemplary aspects, embodiments, options, and/or configurations illustrated herein show the various components of the system collocated, certain components of the system can be located remotely, at distant portions of a distributed network, such as a local area network (LAN) and/or the Internet, or within a dedicated system. Thus, it should be appreciated, that the components of the system can be combined in to one or more devices, such as a Personal Computer (PC), laptop, netbook, smart phone, Personal Digital Assistant (PDA), tablet, etc., or collocated on a particular node of a distributed network, such as an analog and/or digital telecommunications network, a packet-switch network, or a circuit-switched network. It will be appreciated from the preceding description, and for reasons of computational efficiency, that the components of the system can be arranged at any location within a distributed network of components without affecting the operation of the system. For example, the various components can be located in a switch such as a private branch exchange (PBX) and media server, gateway, in one or more communications devices, at one or more users' premises, or some combination thereof. Similarly, one or more functional portions of the system could be distributed between a telecommunications device(s) and an associated computing device.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

Also, while the flowcharts have been discussed and illustrated in relation to a particular sequence of events, it should be appreciated that changes, additions, and omissions to this sequence can occur without materially affecting the operation of the disclosed embodiments, configuration, and aspects. Further, a number of variations and modifications of the disclosure can be used. It would be possible to provide for some features of the disclosure without providing others.

Optionally, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In one embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or very-large-scale-integration (VLSI) design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or computer-generated imagery (CGI) script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

Examples of the processors as described herein may include, but are not limited to, at least one of Qualcomm® Snapdragon® 800 and 801, Qualcomm® Snapdragon® 610 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARN4926EJ-S™ processors, other industry-equivalent processors, and may perform computational functions using any known or future-developed standard, instruction set, libraries, and/or architecture.

The invention claimed is:

1. An apparatus for coating an elongate workpiece with fluids, comprising:

a carriage with a securement device adapted to secure a first end of the elongate workpiece to the carriage;

a dip block spaced from the carriage, the dip block including a first tray for a first fluid and a second tray for a second fluid;

a vertical drive system operable to move the carriage relative to the dip block;

a first holder with a first coating tube extending downwardly from the first tray, the first holder configured to receive the first fluid;

a second holder with a second coating tube extending downwardly from the second tray, the second holder configured to receive the second fluid;

a horizontal drive element configured to move the dip block between a first position in which the first holder is aligned to receive a second end of the elongate workpiece and a second position in which the second holder is aligned to receive the second end of the elongate workpiece;

a first circulation system associated with the first tray, wherein the first circulation system is operable to automatically adjust the first coating tube with the first fluid when the dip block is in the second position; and a second circulation system associated with the second tray, wherein the second circulation system is operable to automatically adjust the second coating tube with the second fluid when the dip block is in the first position.

2. The apparatus of claim 1, further comprising a first sensor associated with the first tray, the first sensor operable to determine a level of a surface of the first fluid in at least one of the first tray and the first coating tube.

3. The apparatus of claim 2, wherein the first sensor is a fiber optic fluid level sensor.

4. The apparatus of claim 1, wherein the first circulation system comprises a first pump operable to move the first fluid from a first fluid reservoir to the first tray.

5. The apparatus of claim 4, further comprising a first weir in the first tray, the first weir interconnected to the first fluid reservoir, wherein when the vertical drive system lowers the carriage and the second end of the elongate workpiece moves into the first coating tube, some of the first fluid is expelled from the first coating tube and flows over the first weir and into the first fluid reservoir.

6. The apparatus of claim 1, further comprising a control system in communication with the apparatus, the control system operable to:

receive data from a sensor;

determine if the first fluid is not at a predetermined level in one or more of the first tray and the first coating tube; and when the dip block is in the second position, activate a pump to move more of the first fluid into the first tray and the first coating tube.

7. The apparatus of claim 6, wherein the control system is further operable to:

generate a user interface;

display the user interface on an output device; and receive an input from an operator to set the predetermined level.

8. The apparatus of claim 1, wherein the first holder includes a body with an upper opening to receive the second end of the elongate workpiece, the body further comprising an aperture through the body for the first fluid to flow into the first coating tube.

9. The apparatus of claim 1, wherein the first circulation system is operable to automatically adjust a level of the first fluid in the first tray while the second end of the elongate workpiece is within the second coating tube.

* * * * *